US008650824B2

(12) United States Patent
DeLong et al.

(10) Patent No.: US 8,650,824 B2
(45) Date of Patent: Feb. 18, 2014

(54) INTERLOCKING FLOOR TILE

(71) Applicant: Johnsonite Inc., Chagrin Falls, OH (US)

(72) Inventors: Patrick DeLong, Kent, OH (US); Joseph M. Visintin, Newbury, OH (US); Phillip J. Kramer, Poland, OH (US)

(73) Assignee: Johnsonite Inc., Chagrin Falls, OH (US)

( * ) Notice: Subject to any disclaimer, the term of this patent is extended or adjusted under 35 U.S.C. 154(b) by 0 days.

(21) Appl. No.: 13/706,058

(22) Filed: Dec. 5, 2012

(65) Prior Publication Data

US 2013/0139464 A1 Jun. 6, 2013

Related U.S. Application Data

(63) Continuation-in-part of application No. 13/311,979, filed on Dec. 6, 2011.

(51) Int. Cl.
*E04F 15/22* (2006.01)
*E04B 2/00* (2006.01)

(52) U.S. Cl.
USPC ..... 52/403.1; 52/588.1

(58) Field of Classification Search
USPC ..... 52/588.1, 586.1, 592.1, 589.1, 177, 52/403.1, 390, 385
See application file for complete search history.

(56) References Cited

U.S. PATENT DOCUMENTS

| | | | | |
|---|---|---|---|---|
| 1,661,037 | A * | 2/1928 | Gammeter | 404/33 |
| 4,649,069 | A * | 3/1987 | Tone | 428/82 |
| 4,766,022 | A | 8/1988 | Tone | |
| 4,890,432 | A | 1/1990 | Shepherd | |
| 4,945,697 | A * | 8/1990 | Ott et al. | 52/403.1 |
| 4,973,505 | A | 11/1990 | Bielous | |
| 5,899,038 | A | 5/1999 | Stroppiana | |
| D419,697 | S | 1/2000 | Kroesbergen | |
| D449,120 | S | 10/2001 | Kulik | |
| D486,592 | S * | 2/2004 | Hong | D25/138 |
| 6,694,689 | B1 * | 2/2004 | Scott et al. | 52/392 |
| D497,212 | S | 10/2004 | Poliacek et al. | |
| 7,086,205 | B2 | 8/2006 | Pervan | |
| 7,127,860 | B2 | 10/2006 | Pervan et al. | |
| 7,275,350 | B2 | 10/2007 | Pervan et al. | |
| 7,340,865 | B2 | 3/2008 | Vanderhoef | |
| 7,356,971 | B2 | 4/2008 | Pervan | |
| 7,484,338 | B2 | 2/2009 | Pervan et al. | |
| 7,516,588 | B2 | 4/2009 | Pervan | |
| 7,610,731 | B1 | 11/2009 | Collison | |
| 7,676,995 | B2 | 3/2010 | Vanderhoef | |
| 7,677,001 | B2 | 3/2010 | Pervan | |
| 8,192,823 | B2 * | 6/2012 | Hainbach | 428/78 |
| 2002/0178682 | A1 | 12/2002 | Pervan | |
| 2003/0093964 | A1 * | 5/2003 | Bushey et al. | 52/592.1 |

(Continued)

*Primary Examiner* — Andrew Triggs
(74) *Attorney, Agent, or Firm* — D. Peter Hochberg; Sean F. Mellino; Richard A. Wolf

(57) ABSTRACT

A flexible interlocking floor tile having a dual construction with an interlocking mechanism allows for easy installation of multiple tiles. The dual construction can include recycled material and virgin or new material. The tile also includes an adequate support at the corner of the tile when assembling multiple tiles. The tile has a single interlocking structure or groove to keep the entire tile joint tight with other tile joints, instead of interrupted interlocking structure which can lead to functional and aesthetic flaws in the entire floor. The single continuous interlocking structure allows for a one-step easy removal of any excess material or flashing from the tile after the molding process.

25 Claims, 17 Drawing Sheets

(56) References Cited

U.S. PATENT DOCUMENTS

| | | | | |
|---|---|---|---|---|
| 2004/0035079 | A1 | 2/2004 | Evjen | |
| 2005/0183370 | A1* | 8/2005 | Cripps | 52/591.5 |
| 2006/0283127 | A1* | 12/2006 | Pervan | 52/592.1 |
| 2007/0011980 | A1* | 1/2007 | Stegner et al. | 52/586.1 |
| 2007/0159814 | A1 | 7/2007 | Jacobsson | |
| 2008/0000194 | A1 | 1/2008 | Pervan et al. | |
| 2008/0010937 | A1 | 1/2008 | Pervan et al. | |
| 2008/0028707 | A1 | 2/2008 | Pervan | |
| 2008/0037284 | A1 | 2/2008 | Rudisill | |
| 2008/0209840 | A1 | 9/2008 | Vanderhoef | |
| 2009/0062432 | A1* | 3/2009 | Doesburg et al. | 524/16 |
| 2011/0167744 | A1* | 7/2011 | Whispell et al. | 52/309.1 |
| 2012/0009377 | A1* | 1/2012 | Dodge et al. | 428/90 |
| 2012/0189819 | A1* | 7/2012 | Chang | 428/172 |
| 2012/0322517 | A1* | 12/2012 | Valdez | 455/575.8 |
| 2013/0139463 | A1* | 6/2013 | DeLong | 52/588.1 |
| 2013/0139464 | A1* | 6/2013 | DeLong et al. | 52/588.1 |

* cited by examiner

INTERLOCKING FLOOR TILE

CROSS-REFERENCE TO RELATED APPLICATION

This application is a continuation-in-part of U.S. patent application Ser. No. 13/311,979 filed Dec. 6, 2011 which is incorporated by reference in its entirety.

BACKGROUND OF THE INVENTION

1. Field of the Invention

The invention relates to floor tiles, and is directed in particular to a type of flexible interlocking floor tiles made from rubber or the like. More particularly, the invention relates to interlocking floor tiles which can be easily manufactured and installed without the need of a professional installer, and without requiring the use of glue or other adhesive in the installation of the floor tiles.

2. Description of the Prior Art

Various types of commercial flooring are known in the art. Places which utilize commercial flooring are usually high traffic areas and include office buildings, hospitals, recreation centers, hotels, apartment buildings, etc. These high traffic areas often require durable yet inexpensive flooring with aesthetic appeal as well. Traditional wood flooring is expensive and difficult to maintain and is not ideal for commercial use. Ceramic and stone flooring, laminate tiles, vinyl tiles/planks and LVT (luxury vinyl tiles) are all alternatives to wood flooring but are also expensive—these types of flooring and tiles are also rigid, not flexible or cut resistant, and are not as slip resistant as floors containing rubber. Carpet is not usually desired in high traffic areas since it will wear very quickly, is difficult to clean and must be replaced often, and may impede the travel of vehicles thereacross. Even if the above types of flooring are chosen for commercial use, they require significant time and effort to properly install. If a new building is being constructed, construction may be delayed based on the time it takes for installation of any of the above flooring. Furthermore, removing and replacing any of the above floor types is also expensive and time consuming, which may cause delays in actual operation of the business inside the building. Some such removal and replacement is at times done at night or on weekends so as not to obstruct traffic where such activities are being done. Should the original flooring contain asbestos, removal becomes even more costly due to the procedures necessary for such removal and disposal Based on the above shortcomings of the various flooring mentioned, cheaper yet durable flooring made from rubber, vinyl and the like has been used for commercial settings. Such flooring usually comprises individual molded tiles, panels, boards etc. which interlock together and are placed over a subfloor. Various types of interlocking mechanisms are known in the art. For example, Johnsonite Inc. of Chagrin Falls, Ohio has manufactured an interlock tile under the name UNDERLOCK®. The UNDERLOCK® tile features an interlocking mechanism in the form of a tongue and groove connection on the underside of the tile which fit together like a puzzle without the need for an adhesive either between the respective tiles, or between the tiles and the floor or subfloor. These UNDERLOCK® tiles are easy to install and uninstall and can be done without a professional installer.

One drawback with most molded products is the presence of flashing that is left behind on the product after the molding process. Flashing is excess material which exists in a thin layer exceeding normal part geometry of the product. The flashing extends from a molded product, and must usually be removed. Flashing is typically caused by leakage of the molding material between the two surfaces of a die or mold that actually leaks out of the mold. The leakage is often due to excess material in the mold which exceeds normal part geometry. With respect to interlocking flooring assemblies, flashing must be removed in order to ensure a precise interlocking fit between the tiles. Any excessive flashing which is not removed from the interlocking tiles may compromise the integrity of the mating of the tiles, which could lead to uneven flooring, curling and peaking etc., and also may add difficulty to the installation of such tiles. The flashing is typically removed during the production process with a utility knife or other tool to cut away and remove the excessive flashing. Since removal of the flashing is another time consuming and costly step, a quick and easy method for such removal is desired. Flash removal is particularly time consuming for tiles having intersecting edges which are not straight. Thus, flash removal must occur along curved edges or edges which are not straight, requiring additional time and expense for this tedious process. Flash removal is thus a serious impediment to molded floor tile installers.

Additionally, some tiles feature a studded partial backing to keep the tiles raised above the subfloor while providing air space between the studs. Such studs allow less contact with the subfloor in the event contaminants and liquids are present. However, the studs extend only over the tongue and groove configuration or interlocking mechanism and do not cover the entire bottom of this type of tile. The tongue and groove configuration is often an important feature of this type of tile.

U.S. Publication No. 2005/0183370 to Cripps discloses a floor tile with interlocking edge elements that enable juxtaposed tiles to be assembled by a vertical snap or press-in assembly method to secure tiles together. A first and second pair of contiguous lateral extension walls of the tile are arranged to meet at a square corner of approximately ninety degrees and lie at opposite edges of the tile from the first two lateral extension walls. The second lateral extension walls meet at a common corner that is diagonally opposite from another corner. The floor tile has two channels as a result of first and second lateral extension walls which form part of the interlocking mechanism. The sidewalls forming the channels include an undercut as part of the interlocking mechanism. The tile does not include a downwardly extending member at the corner of the tile for additional support at the corner of tile. The floor tile is made from one material rather than a dual construction made of two materials. Furthermore, the floor tile of Cripps is a two piece construction which further includes a separate, compressible seal.

U.S. Publication No. 2007/0011980 to Stegner et al. discloses a unitary interlocking floor tile with interlocks located on adjacent sides of the tile having a gap located at a mid point of the interlocks along each side of the tile, creating a discontinuous interlocking structure on the sides of the tile. The interlocking structure does not fully extend to the corner of the tile. Stegner et al. does not teach a continuous interlocking structure on adjacent sides of a tile extending to the corner of the tile. The discontinuous interlocking structure of Stegner et al. leads to multiple joints when interconnecting the tiles, which can result in a loose fit amongst the tiles, creating both functional and aesthetic problems. If the discontinuous interlocking structure is not a completely straight line between the gap, realignment problems can occur when fitting multiple tiles together, especially if the tiles are staggered and not side by side. The discontinuous locking structure also results in an excessive amount of time required to remove the flashing from the interlocking structure as well as requiring additional time for the installer to remove such flashing, since the direction for the utility knife to move must be interrupted on different sides of the tile. This is due to the gap located at a mid-point of the interlocks along each side of the tile, wherefore the installer cannot remove the flashing in a single motion using a utility knife. The interlocking floor tile is made of one material.

U.S. Publication No. 2003/0093964 to Bushey et al. discloses a floor grid system including a number of interconnectable tiles made from one material. The tiles are interconnected with one another through the use of locking assemblies extending between the tiles. The locking assembly uses half dove tails as the interlocking configuration. The upper face of the tile includes two locking elements on two adjacent sides of the upper face of the tile. The bottom face of the tile includes two locking elements on the opposite adjacent sides of the bottom face of the tile. Each locking element includes a base projecting outwardly from the tile and an upwardly extending vertical member having an inner surface spaced from a corresponding side of the tile so as to define a wall receiving channel therebetween. The locking elements on adjacent sides of the tile extend beyond the corner of the tile, with a vertical protrusion located that the intersection of the locking elements. Bushey et al. does not include a downwardly extending member at the corner of the tile. Furthermore, the locking elements have numerous edges in difficult directions causing a large amount of time for flash removal.

U.S. Publication No. 2010/0319282 to Ruland discloses a vinyl floor panel prepared from a blend of a polymer and cork granules. The tiles may are interconnected with one another through the use of a locking system between the tiles. Similar to Bushey et al. discussed above, the locking elements on adjacent sides of the tile extend beyond the corner of the tile, with a vertical protrusion located that the intersection of the locking elements. Ruland does not include a downwardly extending member at the corner of the tile.

Accordingly, there is a need for a tile with an interlocking mechanism which is partly spaced from the floor or subfloor and possible contaminants on the floor or subfloor when installed. Such a tile should be easy to manufacture and allow for some purposeful misalignment of seams of the tile to allow for different layout designs and for multiple size tiles to be fitted together, which does not detract from the aesthetics of the tiles when laid or from their functionality. The tile should be inexpensive yet fulfill its purpose of being an easy to install, durable having a long life, and be able to withstand its intended loads. There is also a need for a tile which reduces the amount of flashing to be removed, and which is easier to install and re-install than existing tiles, saving installation time. Desirably, such a tile would allow for a continuous connection along all of the sides of the tile and include adequate support at the corner of the tile. The latter feature would prevent depression, sinking, bending or buckling of the corners of overlapping, installed tile portions, as when the heel of a high heel shoe is pressed thereon. The desired tile would have a single interlocking structure or groove to keep the entire tile joint tight with other tile joints, instead of interrupted interlocking structure which could lead to functional and aesthetic flaws in the entire floor. The single continuous interlocking structure would allow for a one-step easy removal of any excess material or flashing from the tile after the molding process. The tile would desirably include a random or continuous uniform distribution of shallow studs on the entire bottom of the tile to allow for less contact with the underfloor should it contain contaminants. Construction with studs also makes the tile lighter and easier to install, lift up in the event one has to inspect the floor below it or to replace a tile. Being of less weight is also more environmentally responsible, allowing less fossil fuel to be used for shipping the tile to its final destination. Most desirably, such a unit maintains a strong, structurally sound mounting of the tile on the floor which allows for easy installation. Time saving is particularly important in multiple room facilities where flooring needs to be installed quickly and cost efficiently such as for apartment buildings, hospitals, hotels and the like, where new building construction and renovations are common. The tiles can be removed and reused or repurposed in other areas, avoiding costly landfill charges, making them yet more environmentally friendly. Thus, the problem to be solved by the present invention is to provide a tile with the above characteristics.

Many floor tiles are made from expensively compounded vinyl, linoleum or rubber containing no inexpensive recycled materials. This can be costly, particularly for commercial buildings with extensive floor space to be covered with the tile. It would be advantageous to employ less expensive tiles with inexpensive recycled vinyl, rubber or the like on part of the underside of the tile where it is not visible after it is laid, yet serves its intended purpose and has all of the necessary structural features.

SUMMARY OF THE INVENTION

The present invention provides a flooring solution to the above-described problems of producing and installing interlocking floor tiles. Applications of the interlocking floor tile according to the present invention may include covering access floors, temporary office quarters, workout areas, subfloors with high moisture content or even trade show floors—areas where performance and flexibility are equally important. Other uses include areas where only a temporary solution is needed. The interlocking floor tiles are designed to fit together without the locking structure underneath the respective tiles being readily observable, and if observed being nevertheless aesthetic. Damaged tiles can be easily removed according to the preferred embodiment of the invention as discussed below, even in the middle of the floor and replaced, without any special tools required; removal and replacement are accomplished as discussed below, by simply pulling up the damaged tile and replacing it. The preferred embodiment is inexpensive compared with existing interlocking floor tiles in that it is a dual construction, made in part of inexpensive material such as inexpensive recycled material, especially recycled rubber which does not detract from the functional or appearance of the more expensive components of the tile.

It is an object of the present invention is to provide an interlocking floor tile having a dual construction and comprises in part non-observable recycled rubber or other material having a lower cost than the visible portion of the tile.

Another object of the present invention is to provide an interlocking floor tile that can be easily installed and reinstalled without necessarily requiring a skilled installer.

It is also an object of the present invention to provide an interlocking floor tile which could be installed using a seam roller or hand seam roller to locking the respective tiles together.

Another object of the present invention is to provide an interlocking floor tile having a continuous connection along all of the sides to keep the entire joint tight between the tiles.

Still another object of the present invention is to provide a tile with adequate support at the corner of an installed set of tiles.

A further object of the present invention is to provide an interlocking floor tile with an interlocking mechanism which is not completely and directly exposed to the subfloor and any contaminants thereon.

It is a further object of the present invention is to provide an interlocking floor tile which does not require an adhesive for installation either between the respective tiles or between the tiles and the floor or subfloor.

Still another object of the present invention is to provide an interlocking floor tile which is portable and can be used for both temporary and permanent installations.

Another object of the present invention is to provide an interlocking floor tile which can be placed directly over uncured concrete slabs.

A still additional object is to provide an improved interlocking floor tile system that can be installed on subfloors with high moisture content.

A further object of the present invention is to reduce significant installation time and the associated expense with flooring installation techniques making it easier to lay the inventive tiles as compared to laying existing tiles, and by reducing flashing that must be removed and the overall time required for installation.

It is also an object of the present invention to provide improved, interlocking floor tiles with easy to remove flashing if such flashing does occur.

Yet another object of the present invention is to provide an interlocking floor tile which can be easily removed due to damage or other problems and replaced without any special tools.

Still another object of the present invention is to reduce the weight of the tile without reducing the functions of the tile or the area of coverage of each tile, by incorporating shallow studs on the bottom of the entire tile, which would additionally make the improved tile easier to install, remove and \transport.

Yet another object of the present invention is to provide an interlocking floor tile which is slip resistant.

It is yet still another object of the invention to provide an improved interlocking floor tile which can be easily maintained.

A further object of the present invention is to provide an interlocking floor tile which is fire resistant and has a Class 1 Flame Rating.

Another object of the present invention is to provide an interlocking floor tile that can accommodate various size tiles to create unique and aesthetic patterns.

It is also an object of the present invention to provide an improved interlocking floor tile having the advantages noted above which can be laid in a traditional corner-to-corner pattern or offset in any length to create a staggered look.

It is a general object of the invention to provide an improved tile which is effective in its production, installation and use, and which can be manufactured efficiently and economically.

BRIEF DESCRIPTION OF THE DRAWINGS

Other characteristics and advantages of the present invention will emerge from reading the detailed description hereinbelow of nonlimiting embodiments of the invention, and examining the attached drawings wherein.

DETAILED DESCRIPTION OF THE PREFERRED EMBODIMENTS

Figure 1A:
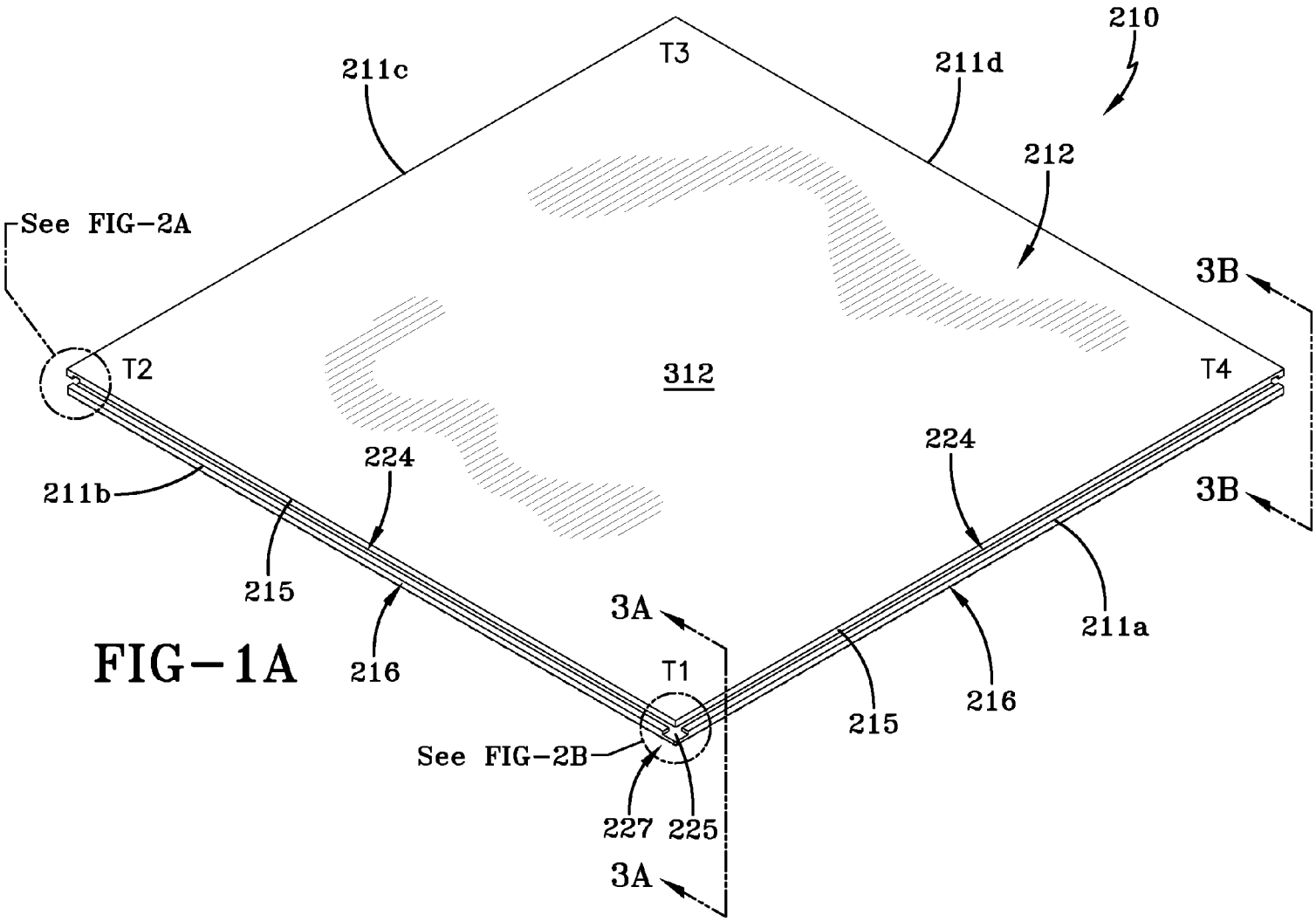
FIG. 1A is a top perspective view of the interlocking floor tile according to the present invention.

The preferred embodiment of the present invention relates to an improved floor tile with an interlocking mechanism which is easy to be laid with a quality installation. The surface of the installed inventive floor tile is not completely and directly exposed to the subfloor and any contaminants thereof. The interlocking floor tile can be formed of any suitable flexible material, such as natural or synthetic rubber, among others. The tiles are not limited to a specific size but can be designed in any size to accommodate the size of the subfloor or floor and the space to be covered. The tile is preferably composed of an attractive exposed material when installed, with low cost but effective inexpensive material which is not exposed when the tile is installed. The inventive tile can be placed on a floor or subfloor, slid relative to adjacent tiles to the desired position, and pressed together with the adjacent tile to interlock them together. No adhesive is required or recommended to install tiles according to the preferred embodiment of the invention.

Turning now to FIGS. 1A, 1B and 4A, 4B, illustrated is an example of interlocking floor tile 210 according to the preferred embodiment of the present invention. Each tile 210 is preferably made of dual construction, meaning each tile 210 includes a top portion 212 made from one material and a bottom portion 214 made from a different material (or at least partially from a different material) except for its edge portions which are made from a different material than the bottom portion. One material is preferably a virgin or new material while the other material is preferably a reconstituted or recycled or scrap material (either or any combination referred to as "recycled" herein). It is possible for edge portions of tile 210 to be made solely from the one material, the other material or a combination of the two materials. Both materials preferably have rubber components. In a preferred embodiment, interlocking floor tile 210 is composed of approximately 73% recycled rubber and approximately 27% virgin materials, including rubber. Of course, more than two different materials could also be used, and any combination of those different materials could be used as well. Preferably, both portions include rubber components. The edge portions of tile 210 will be explained in greater detail later in the application.

Top portion 212 includes a large top layer 312 which is a finish layer for aesthetics and performance, and can be made from any number of materials known in the art capable of being flexible and resilient to absorb shock and returned if momentarily bent or indented, to its original shape. For example, top layer 312 could be made from rubber, which has a greater elastic effect. Top layer 312 may include a number of different components for performance, such as SBR rubber and clay. SBR (styrenebutadiene-rubber) is a synthetic rubber copolymer consisting of styrene and butadiene. The term "rubber" as used herein includes natural rubber and any compound of synthetic materials similar to rubber, including synthetic rubber, made by polymerizing unsaturated hydrocarbons, such as isoprene and butadiene. In addition to rubber, interlocking tiles also comprise other materials such as fillers. Thus, interlocking tiles are manufactured from a homogeneous composition including such items as rubber, natural fillers such as clay, kaolin or $CaCO_3$, curing agents and natural colorants such as iron oxides and titanium dioxide. Top layer 312 may also include pigments and/or a design for aesthetic purposes. As discussed below, the harder material of top layer 312 is also used for the edge of top portion 212 (FIGS. 1A-3B, 7A-7C) and part of the edge of bottom portion 214 (FIGS. 3A-6B, 8A-8B). Top portion 212 could have a hammered texture.

Bottom portion 214 includes large base layer 300 of less expensive, preferably softer material such as recyclable rubber discussed below. Large base layer 300 extends to a very edge 302 of tile 210 on two sides and, only up to a pair of channels discussed below at edges 304 and 306 of large base layer 300, all depicted in FIGS. 4A, 4B. Base layer 300 provides padding and absorbs some of the shock from loads on tile 210. Base layer 300 can be made from a cheaper material than top layer 312. For example, base layer 300 can be made from industrial rubber scrap or recycled rubber including recycled SBR (styrene butadiene rubber) rubber. New SBR rubber, natural rubber and vulcanized recycled rubber dust may also be used.

Top portion 212 and bottom portion 214 are combined together to form a dual construction tile by vulcanization, which is well known in the art. Top portion 212 comprises a sheet of rubber as defined above while bottom portion 214 includes a sheet of recycled rubber as previously mentioned. The two sheets are then bonded by the vulcanization process without the use of a bonding agent. After the vulcanization of the dual construction is complete, the material is put into a mold in a press. It is possible that during the vulcanization process that the two different sheets of different material may overflow into either top portion 212 or bottom portion 214 in the mold. This also results in edge portions having a combination of new rubber and recycled rubber which is discussed further below.

For the ⅜ inch version, the entire tile comprises approximately 53% recycled or reconstituted material. Top portion 212 is 100% virgin or new material and bottom portion 214 is approximately 73% recycled or reconstituted material. Thus, bottom portion 214 is approximately 27% virgin or new material. For the ¼ inch version, the entire tile comprises approximately 34% recycled or reconstituted material. Top portion 212 again comprises 100% virgin or new material and bottom portion is approximately 73% recycled or reconstituted material and approximately 27% virgin or new material.

In order to meet various performance standards such as slip resistance, abrasion or wear resistance etc., top portion 212 must have a minimum thickness in order to satisfy such standards. Bottom portion 214 can vary in thickness depending on the desired performance of the tile. For example, if a more flexible and softer tile is desired, bottom portion 214 would have a greater thickness than if a less flexible and more rigid tile was preferred. Another way to change the performance standards of tile 210 without changing the thickness of bottom portion 214 requires the use of different materials in top portion 212. The table shown below indicates the differences obtained from the different materials. For example, for ordinary use on floors carrying normal foot traffic, hereinafter called "normal floors," (as opposed to floors (hereinafter called "sports floors") on which there is abusive wear, such as floor receiving impacts and slicing on engagement, as from example athletic facilities where there would be falling free weights, treading by persons wearing ice skates, baseball shoe spikes, golf shoe spikes, football boot cleats, etc.), ⅜ inch thickness has been found to be appropriate. Sports flooring requires a premium formulation with respect to the amount of rubber included and requires a more flexible composition to cushion the abuse from objects stated above. Specifically, top portion 212 of the sports flooring includes approximately 35%-45% rubber while top portion 212 of normal flooring includes approximately 25%-27% rubber. The additional rubber in top portion 212 of the sports flooring provides more flexibility and more cushion as noted above. "Flexible," as used herein, refers to anyone of the definitions of "flexibility" under the ASTM Dictionary of Engineering Science and Technology 10$^{th}$ Edition as follows:

"flexibility—the ability to be bent, turned, or twisted without cracking, breaking or showing other permanent damage and with or without returning of itself to it former shape. F 141"

"flexibility—that property of a material to endure repeated flexing, bending, or bowing without rupture. D 123, D 4850"

One criterion is the resistance to penetration, indicated by Shore A value, as measured by ASTM Standard Test Method D 2240 where the higher the value, the harder the material. Another criterion is sound insulation, which is not as important for floors carrying normal foot traffic, but which is important for sports floors, and is measured using values for Impact Insulation Class or IIC, which is an integer number rating on how well a building floor attenuates impact sound such as footsteps, falling weights, etc. The IIC is logarithmic, and is derived from ASTM method E989 which uses a tapping machine specified in ASTM method E492.

The ⅜ inch thickness has been found effective for interlocking tiles according to a preferred embodiment of the invention for both normal floors and sports floors. The ⅜ inch thickness has been found to render seams between interlocking floor tiles as described above largely unnoticeable. The ⅜ inch thickness has been found to more effectively protect the floor in some instances, but the ¼ inch thickness is less expensive and can adequately protect normal floors.

The following chart shows comparative values for the interlocking floor tile according to a preferred embodiment of the invention for each of normal floors and sports floors:

| ⅜ Inch Inventive Interlocking Floor Tiles for | Normal Floors | Sports Floors |
|---|---|---|
| Wear layer (ASTM F 410) | 0.090" (2.3 mm) | 0.090" (2.3 mm) |
| Total Thickness (ASTM F 386) | ⅜" (9.5 mm) | ⅜" (9.5 mm) |
| Dimensioned stability (ASTM F 2199) | Pass | Pass |
| Chemical resistance (ASTM F 2569) | Pass | Pass |
| Force reduction (ASTM F 2569) | 6 | 6 |
| Impact Sound Resistance (ASTM E 492) | No test | 46(IIC) |
| Hardness (ASTM D 2240) | >85 Shore A | >70 Shore A |
| Static load limit (ASTM F 970) | Pass | Pass |
| Abrasion Resistance (ASTM D 3389) | 1 g loss after 1000 cycles | 1 g loss after 1000 cycles |
| Slip resistance (ASTM D 2047) | ≥0.8 pass | ≥0.8 pass |
| Weight | 3.3 lbs/sq. ft. (15.0 Kg/m$^2$) | 3.3 lbs/sq. ft. (15.0 Kg/m$^2$) |

| ¼ Inch Inventive Interlocking Floor Tiles for | Normal Floors |
|---|---|
| Wear layer (ASTM F 410) | 0.090" (2.3 mm) |
| Total Thickness (ASTM F 386) | ¼" (6.3 mm) |
| Dimensioned stability (ASTM F 2199) | Pass |
| Chemical resistance (ASTM F 2569) | Pass |
| Force reduction (ASTM F 2569) | |
| Impact Sound Resistance (ASTM E 492) | Not tested |
| Hardness (ASTM D 2240) | ≥85 Shore A |
| Static load limit (ASTM F 970) | Pass |
| Abrasion Resistance (ASTM D 3389) | 1 g loss after 1000 cycles |
| Slip resistance (ASTM D 2047) | ≥0.8 pass |
| Weight | 2.2 lbs/sq. ft. (10.0 Kg/m$^2$) |

The overall thickness of the ⅜ inch version of tile 210 is approximately 0.375 inches (⅜") or approximately 9.5 mm. Top portion 212 has a thickness in the range of 0.070-0.110 inches or approximately 1.7 mm-2.8 mm. Preferably, top portion 212 has a thickness of 0.090 inches or 2.3 mm. Bottom portion 214 has a thickness in the range of 0.265-0.305 inches or approximately 6.7 mm-7.7 mm. Preferably, bottom portion 214 has a thickness of 0.285 inches or 7.2 mm. On the other hand, the overall thickness of the ¼ inch version of tile 210 is approximately 0.250 inches (¼") or approximately 6.3 mm. However, in order to meet various performance standards such as slip resistance, abrasion or wear resistance etc. as described above with respect to the ¼ inch version of tile 210, top portion 212 must also have a minimum thickness in order to satisfy such standards, and this minimum thickness is the same as the minimum thickness in the ⅜ inch version of tile 210. That is, for the ¼ inch version of tile 210, top portion 212 has a thickness in the range of 0.070-0.110 inches or approximately 1.7 mm-2.8 mm. Preferably, top portion 212 has a thickness of 0.090 inches or 2.3 mm. Therefore, bottom portion 214 will have a smaller thickness than bottom portion 214 of tile 210. Specifically, bottom portion 214 has a thickness in the range of 0.140-0.180 inches or approximately 3.5 mm-4.5 mm. Preferably, bottom portion 214 has a thickness of 0.160 inches or 4.0 mm.

Each tile 210 can have any desired polygonal shape, but is preferably generally rectangular in shape for ease of interlockability. For tiles having any polygonal shape, a side portion of a first tile will have a specific shape while a side portion of another tile adjacent the side portion the first tile will have a corresponding mating shape. It is also possible for a single tile to have a side portion having a specific shape while a side portion opposite of the first side portion of the tile has a corresponding mating shape so that the two tiles can be interlocking in a firm but releasable engagement. For example, if the tile is in the shape of a crescent moon, a side portion of this tile will have a convex shape, while the shape of a side portion of another crescent moon-shaped tile adjacent the side portion of the first tile will be concave. Thus, the respective side portions have corresponding mating shapes.

Figure 1B:
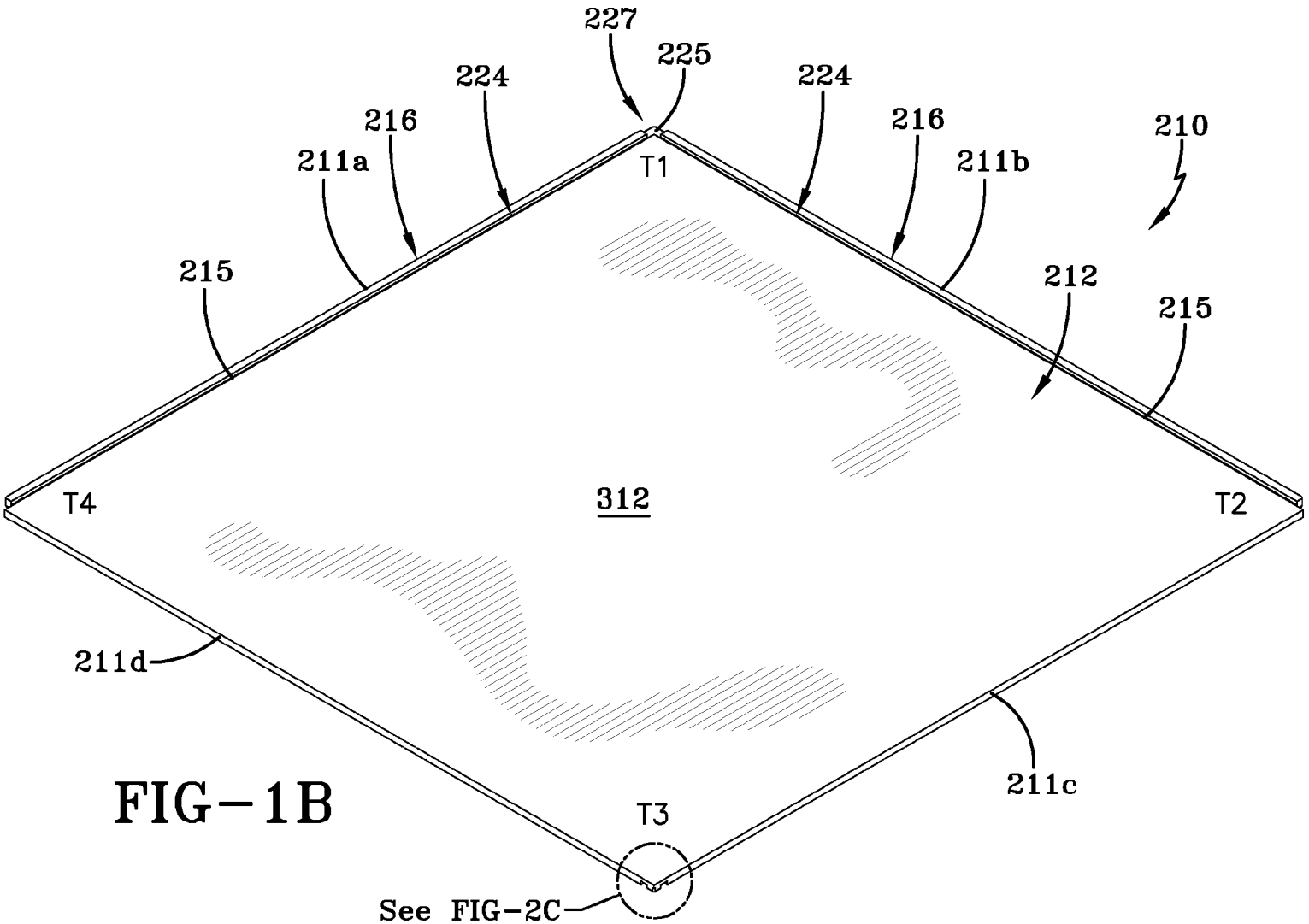
FIG. 1B is a top perspective view of the tile of FIG. 1 shown from another angle of the tile.
Figure 2A:
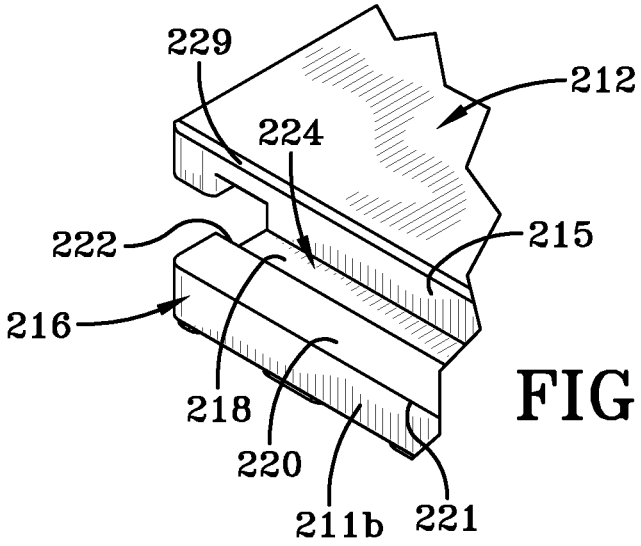
FIGS. 2A-2C are enlarged partial top perspective views of several corners of the tile of FIG. 1.
Figure 2B:
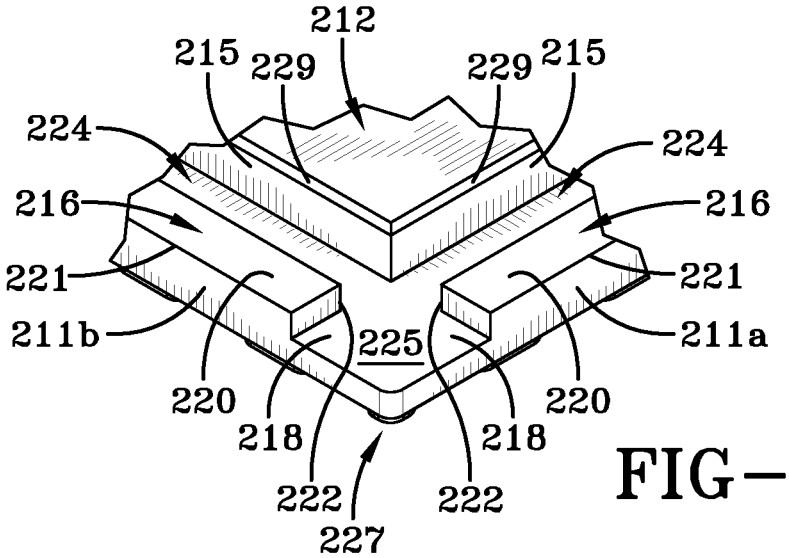
Figure 2C:
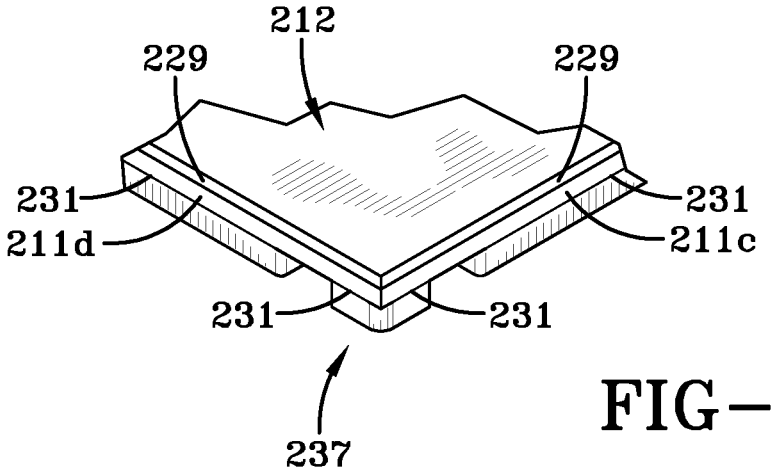

As shown in FIGS. 1A, 1B, top layer 312 includes outwardly-facing top planar sidewalls 215 on each of two adjacent side portions 211*a*, 211*b* of tile 210. A bottom interlocking element set 216 is included in top portion 212, is separated from top layer 312 and is located adjacent outwardly-facing top planar sidewall 215 on each of two adjacent side portions 211*a*, 211*b* of tile 210. Referring to FIGS. 2A-3C, bottom interlocking element set 216 includes a bottom base 218 and a bottom upwardly extending male locking projection 220. Male locking projection 220 includes a parting line 221 (parting line 221 and a parting line 231 discussed below constitute parts of a single parting line) located on its outer surface along side portions 211*a*, 211*b*. Parting line 221 is a small line of material protruding from the outer surface of male locking projection 220 along side portion 211*b*. Parting line 221 is created at the point where the top mold and the bottom mold of tile 210 meet when tile 210 is pressed together where any excess material or flashing escapes between the top mold and bottom mold. Although the excess flashing is removed with a utility knife or similar tool, a small line of material remains and such line is the parting line. The location of parting line 221 will depend upon the size thickness) of the top mold and the bottom mold. For example, if the top mold is the same thickness as the bottom mold, parting line 221 will occur at the midpoint of side portions 211*a*, 211*b* of tile 210 since the top mold will meet bottom mold at this midpoint when pressed together. If the top mold has a greater thickness than bottom mold, parting line 221 would occur below the midpoint of tile 210 where top mold and bottom mold meet when pressed together. Similarly, if bottom mold has a greater thickness than top mold, parting line would occur above the midpoint of tile 210 where top mold and bottom mold meet when pressed together. Parting line 221 assists in the interlocking of tiles 210 as discussed later in the application. Bottom base 218 extends outwardly from outwardly-facing top planar sidewall 215 near bottom portion 214 of tile 210. Bottom upwardly extending male locking projection 220 has an inwardly facing bottom planar wall 222 spaced from outwardly-facing top planer sidewall 215 of corresponding side portions 211*a*, 211*b* of tile 210 so as to define a bottom channel 224 therebetween. Bottom interlocking element sets 216 are made from a dual construction, i.e. they are composed of both virgin material from top portion 212 and of recycled or reconstituted material from bottom portion 214.

Respective bottom interlocking element sets 216 on respective adjacent side portions 211*a*, 211*b* are connected by a bottom base element 225 at a corner 227 of tile 210. Bottom base element 225 is an extension of bottom base 218 but is devoid of any male locking portion projecting therefrom. Bottom base element 225 provides support for a corner post of an adjacent interlocking tile 210 when joined together as further explained below.

Figure 4A:
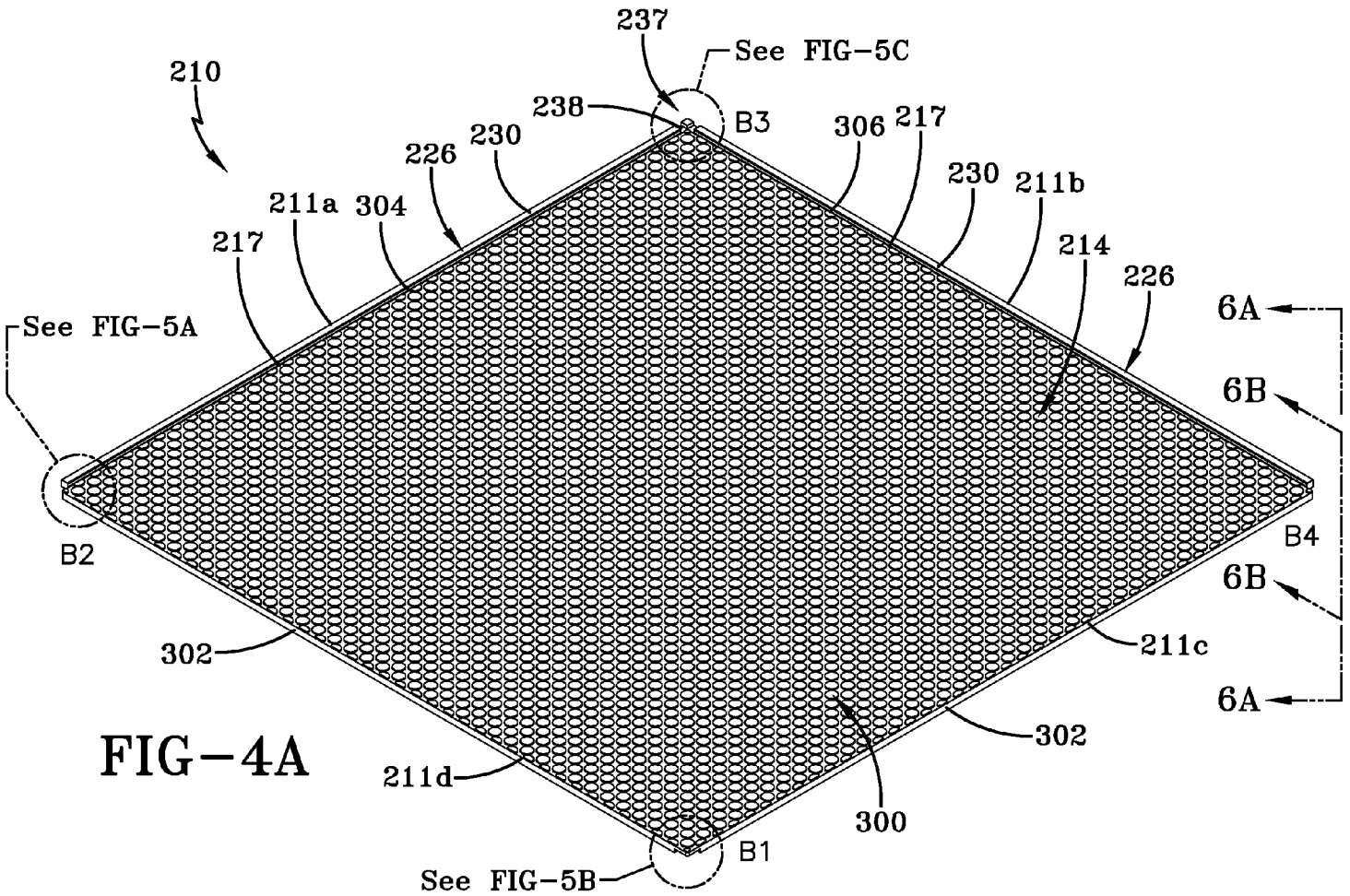
FIG. 4A is a bottom perspective view of the tile of FIG. 1.
Figure 4B:
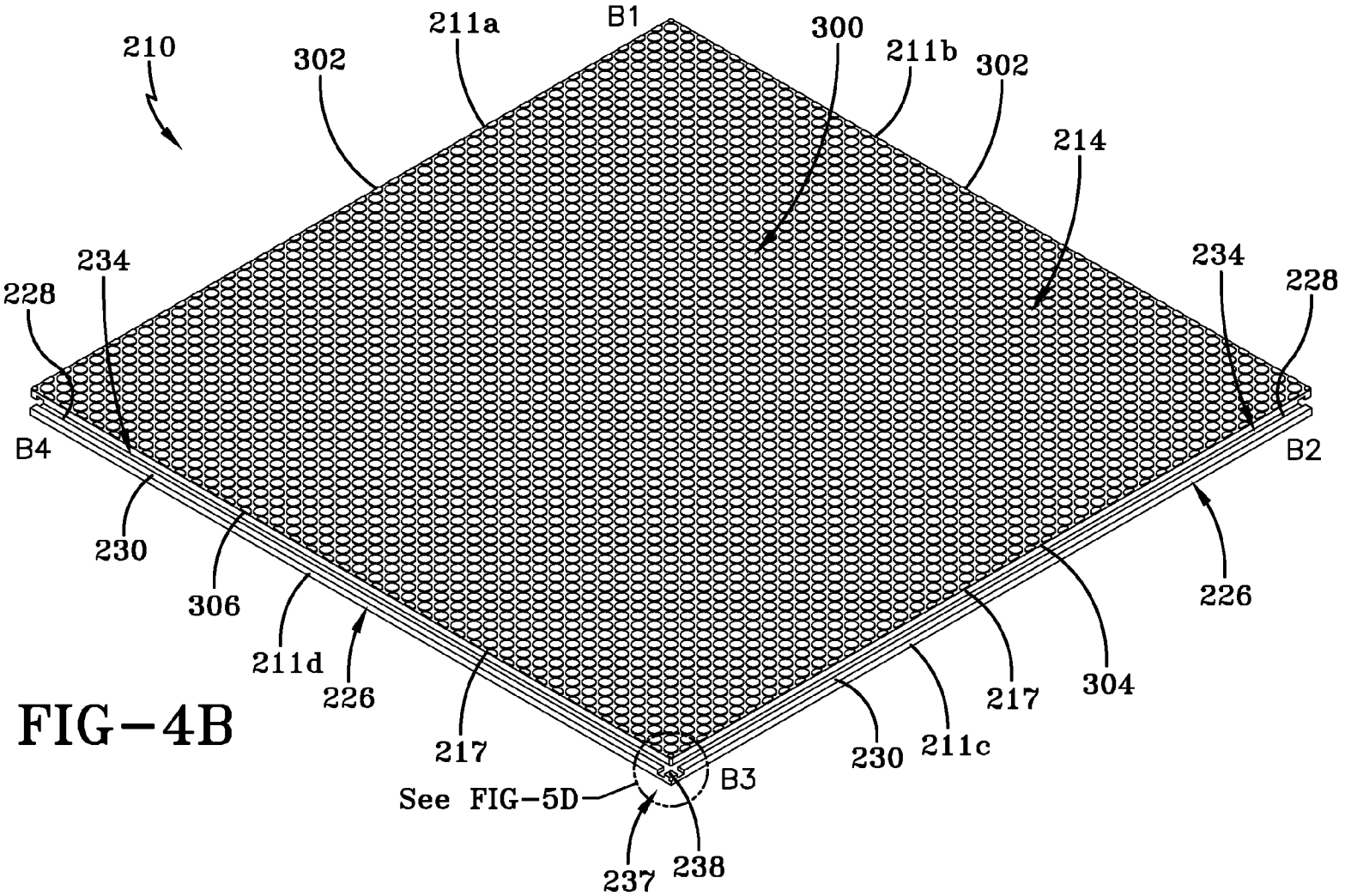
FIG. 4B is bottom perspective view of the tile of FIG. 1 shown from another side of the tile.

When viewed from the bottom, shown in FIGS. 4A, 4B, base layer 300 includes outwardly-facing bottom planar sidewalls 217 on each of the other two adjacent side portions 211*c*, 211*d* opposite from side portions 211*a*, 211*b* on top portion 212 of tile 210. Each adjacent side portion 211*c*, 211*d* includes a top interlocking element set 226. Referring to FIGS. 5A-6B, top interlocking element set 226 includes a top base 228 and a top downwardly extending (when bottom portion 214 is facing downwardly) male locking projection 230. Top downwardly extending male locking projection 230, also includes parting line 231 located on its outer surface along side portions 211*c*, 211*d*. As previously mentioned, parting line 231 is small line of material protruding from the outer surface of male locking projection 230 along side portions 211*c*, 211*d*. As set forth above, parting line 231 and parting line 221 together form a single parting line. Parting line 231 is created at the point where the top mold and the bottom mold of tile 210 meet when tile 210 is pressed together between the top mold and bottom mold. The location of parting line 231 again depends upon the size (i.e. thickness) of the top mold and the bottom mold. That is, if the top mold is the same thickness as the bottom mold, parting line 231 will occur at the midpoint of side portions 211*c*, 211*d* of tile 210 since the top mold will meet bottom mold at this midpoint when pressed together. Parting line 221 will occur below the midpoint of tile 210 where the top mold and the bottom mold meet when pressed together if the top mold is thicker than the bottom mold. Similarly, parting line 231 will occur above the midpoint of tile 210 where the top mold and the bottom mold meet when pressed together if the bottom mold is thicker than the top mold. Parting line 231 assists in the interlocking of tiles 210 as discussed later in the application. Top base 228 projects outwardly from each outwardly-facing bottom planar sidewall 217 of respective side portions 211*c*, 211*d* near the top of tile 210 and top male locking projection 230 extends downwardly from top base 228. Top downwardly extending male locking projection 230 has an inner wall 232 (FIG. 5A) spaced from sidewall 217 of a corresponding side 211*c*, 211*d* of tile 210 so as to define a top channel 234 therebetween.

Figure 5A:
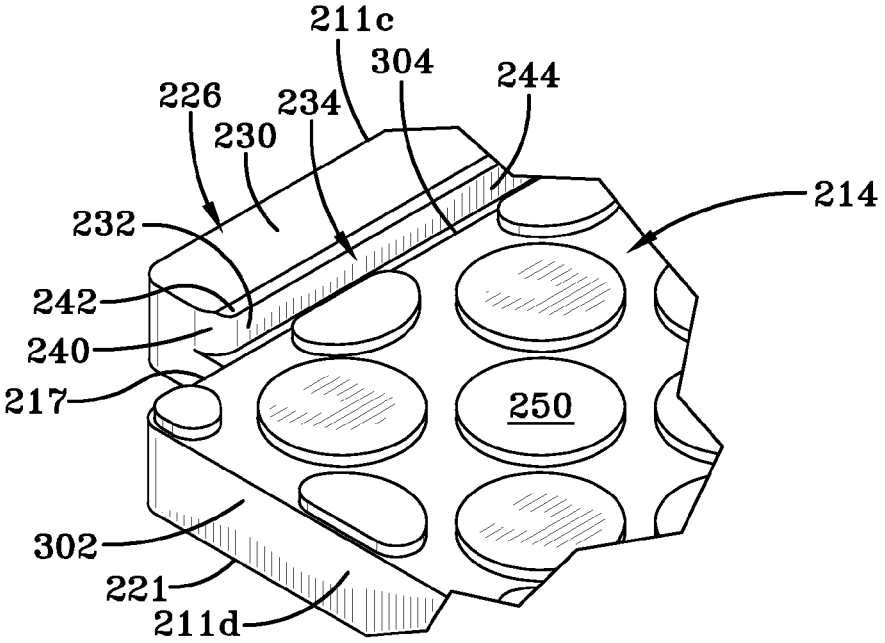
FIGS. 5A-5D are enlarged partial bottom perspective views of several corners of the tile of FIG. 1.
Figure 5B:
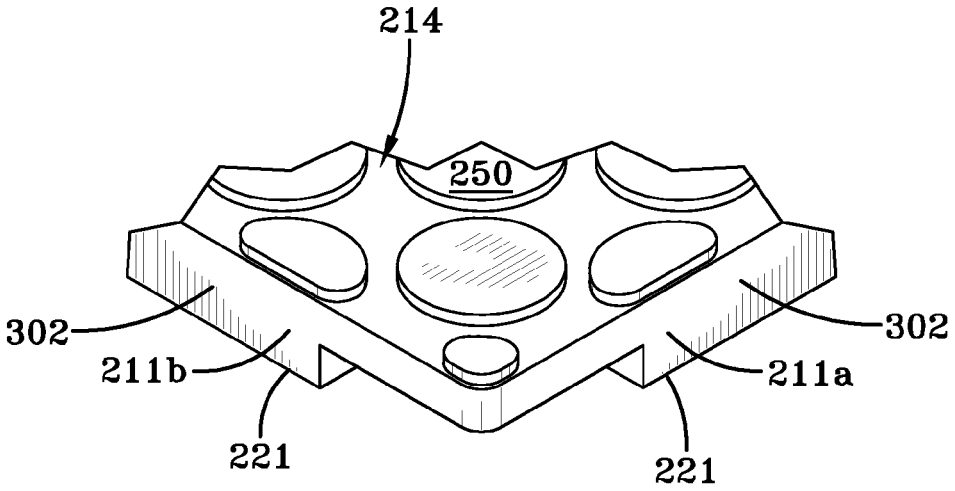
Figure 5C:
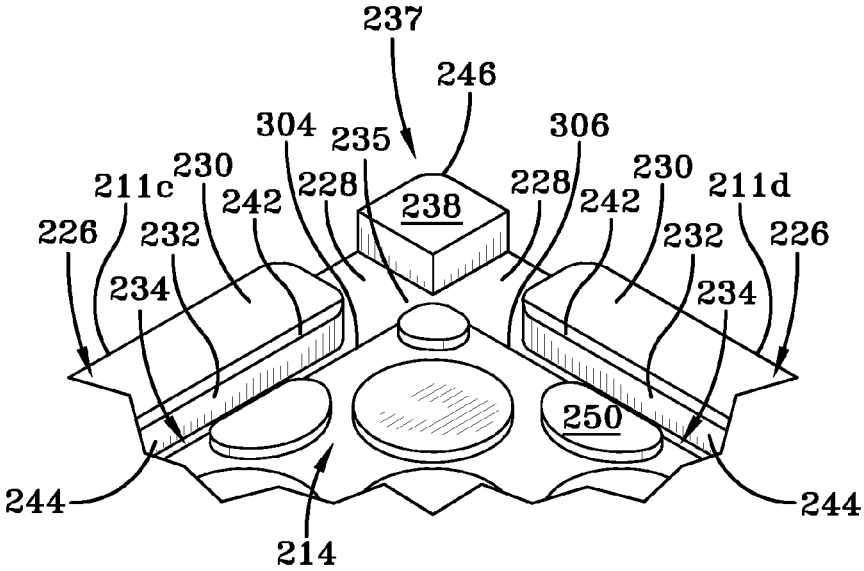
Figure 5D:
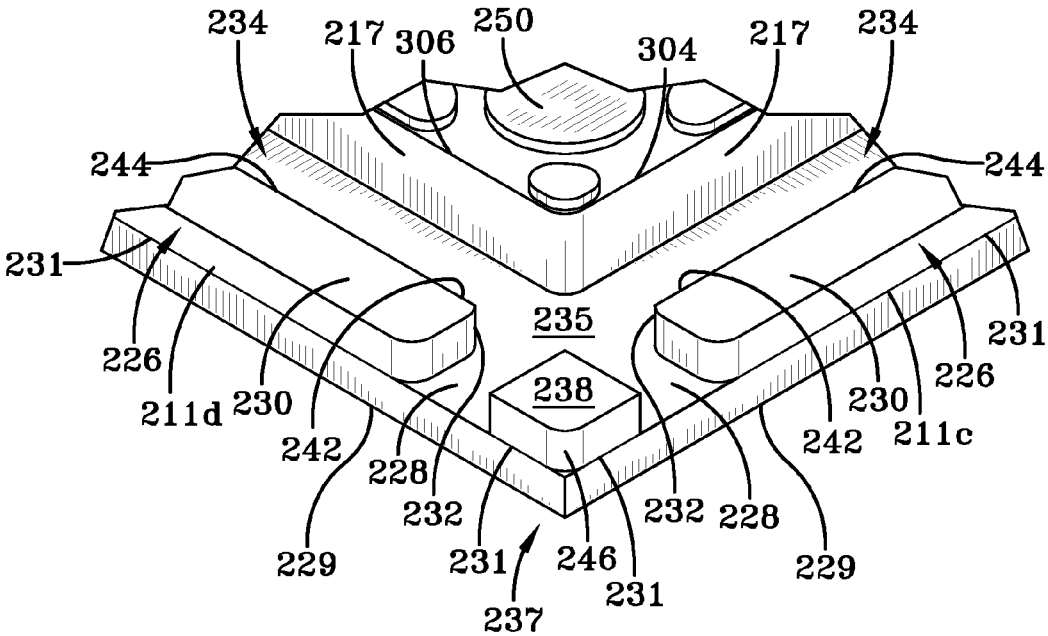
Figure 5E:
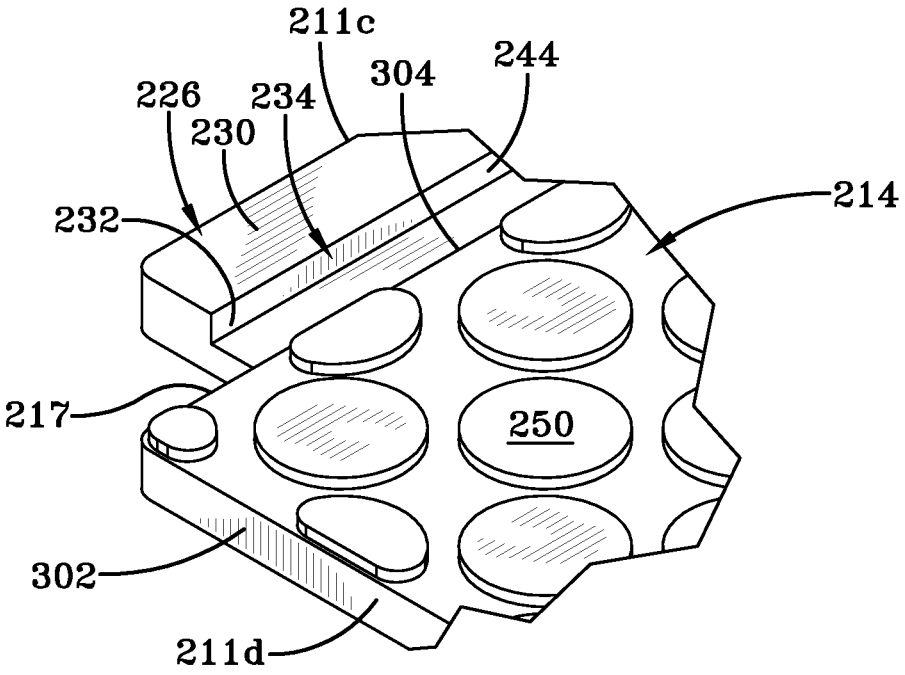
FIGS. 5E-5F are enlarged partial bottom perspective views of several corners the other embodiment of the tile as shown in FIG. 3C.
Figure 5F:
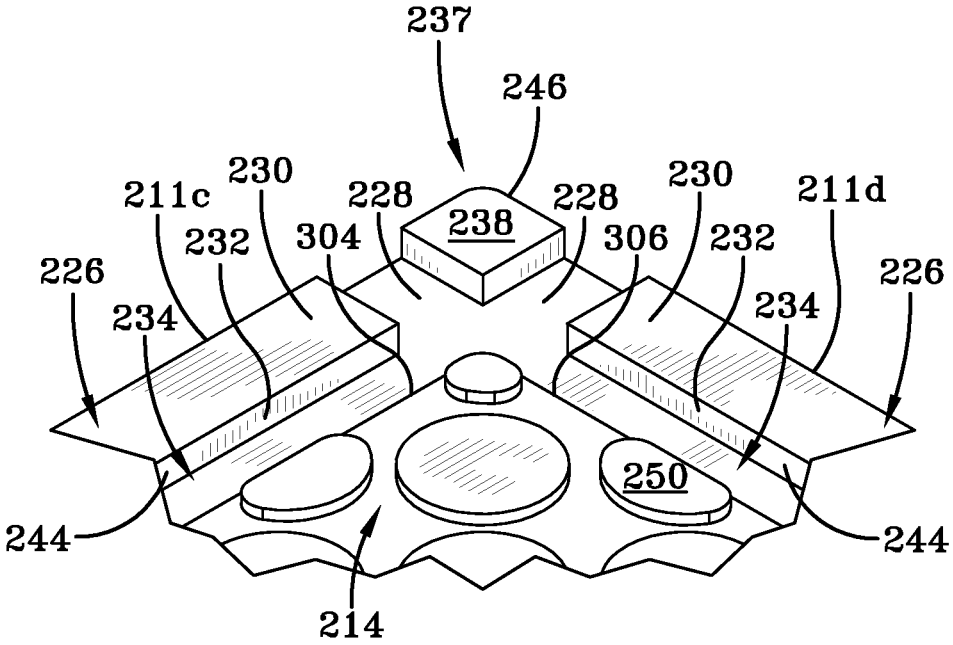
Figure 8A:
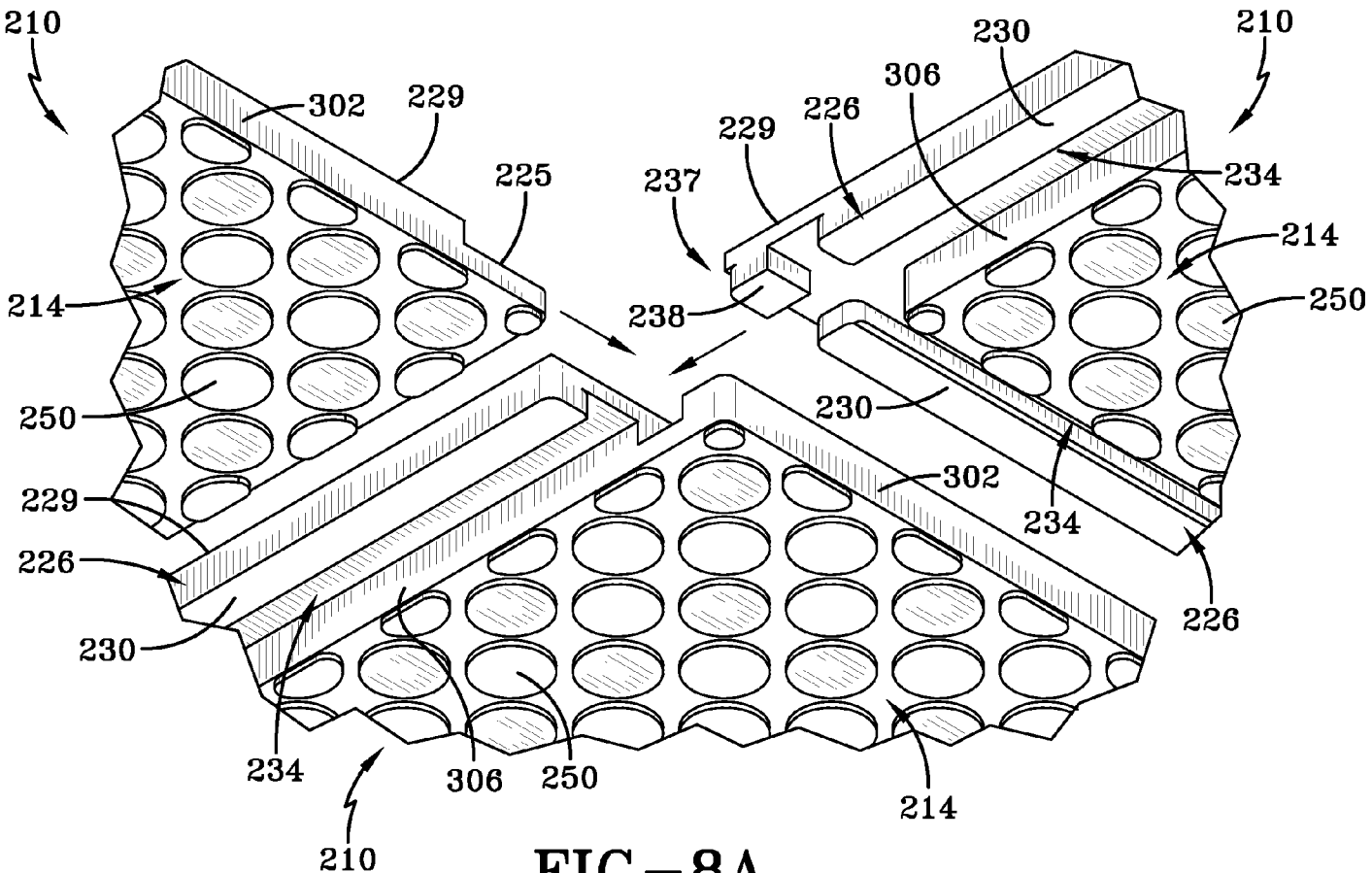
FIG. 8A is a bottom partial perspective view of three adjacent tiles before assembly.
Figure 8B:
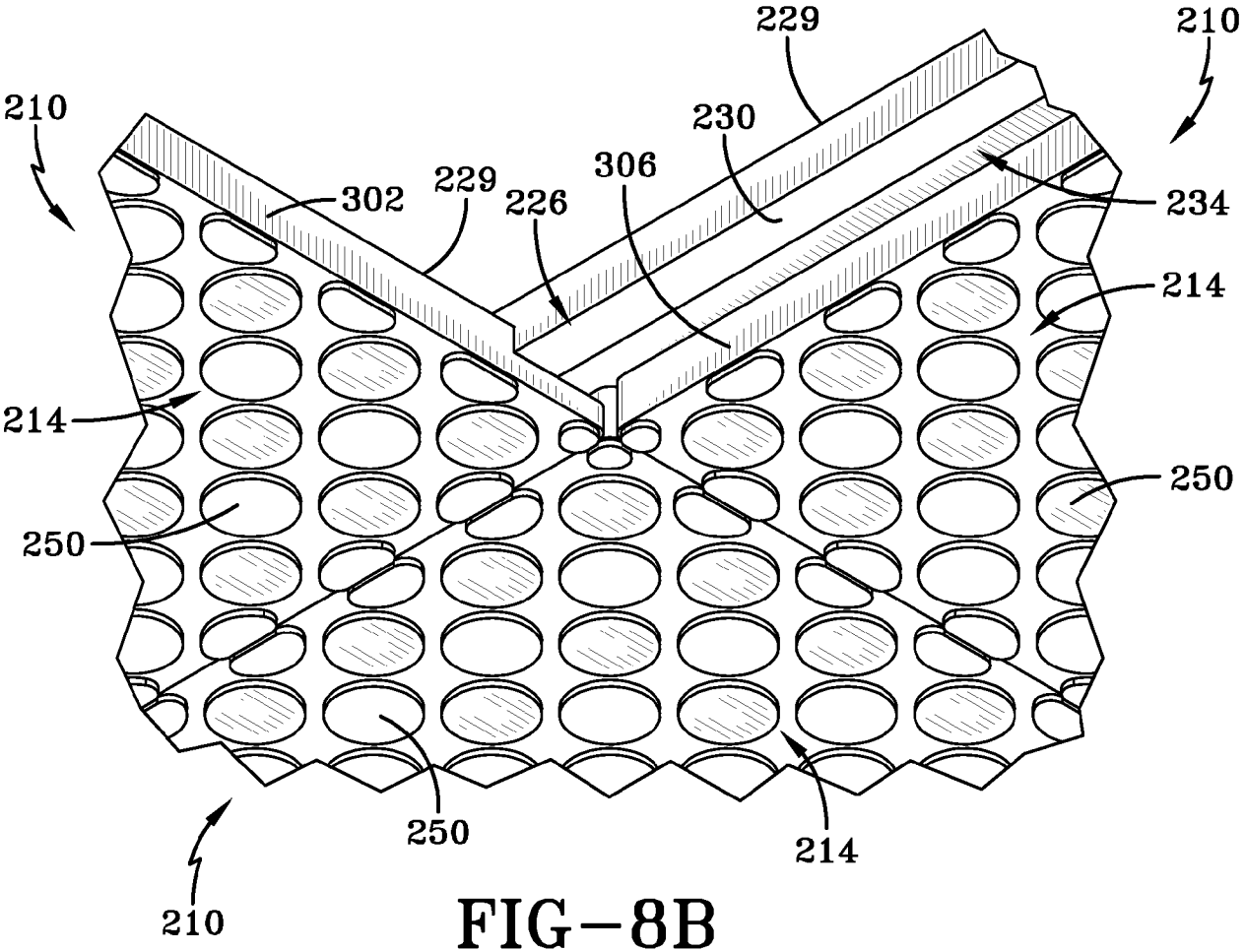
FIG. 8B is a bottom partial perspective view of three adjacent tiles after assembly.

As shown in FIGS. 5C-5D, respective top interlocking element set 226 on respective adjacent side portions 211*c*, 211*d* are connected by a top base element 235 at an upper corner 237 of tile 210, top base element 235 can be viewed as an extension of top base 228. Top base element 235 is substantially the same thickness as top base 228 (i.e., top base element 235 is level with top base 228) and includes a support post 238. Support post 238 depends downwardly from top base element 235 towards the subfloor when tile 210 is installed. Support post 238 provides support in conjunction with bottom base element 225 upon which it is seated near the corner of an adjacent tile 210 when joined together as shown from the bottom of multiple tiles 210 being joined together in FIG. 8A. FIG. 8B shows multiple tiles 210 joined together from FIG. 8A, but support post 238 is hidden from view. Bottom base element 225 on top portion 212 does not have any male projections in order to allow clearance for top male locking element set 226 to pass therethrough when multiple tiles 210 are joined together. When multiple tiles 210 are joined and respective top locking element set 226 and respective bottom locking element set 216 are connected, a void would be created if support post 238 did not exist. Such a void would create a tripping hazard since top base element 235 would not be supported at its upper corner 237 when tile 210 is installed and would be depressed or deformed by a stiletto, spike, cleat, ice skate or other shoe with a pointed structure on the bottom of the shoe. However, support post 238 (FIG. 8A) fills the void and fully supports the corner of tile 210. It is advantageous that support post 238 projects downwardly from top base element 235 rather than being located on bottom base element 225 and projecting upwardly. When depressed by a shoe (or part of a shoe such as a stiletto heel, etc.), support post 238 effectively prevents any movement of upper corner 237 (such as sliding or shearing) with bottom base element 225 of another tile 210. However, if support post 238 was located on bottom base element 225, there is believed to be a greater likelihood that upper corner 237 could slide or shear on support post 238 since support post 238 is not connected to upper corner 237 when depressed by a shoe (or part of a shoe such as a stiletto heal, etc.). This could cause tripping and possible injury to the person walking (or running) on tile 210.

Figure 3A:
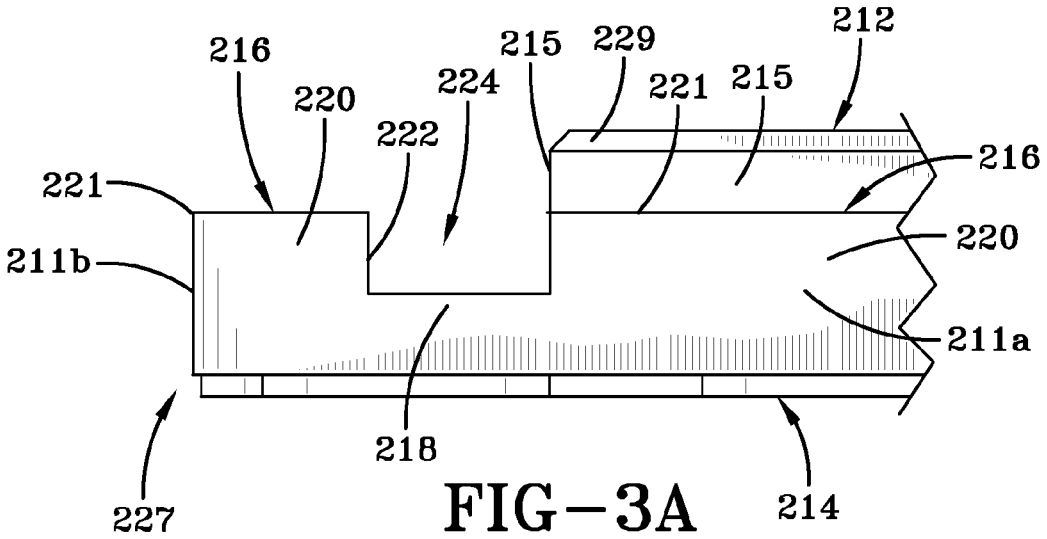
FIG. 3A is a partial side view of a corner of one of the sides of the tile of FIG. 1.
Figure 3B:
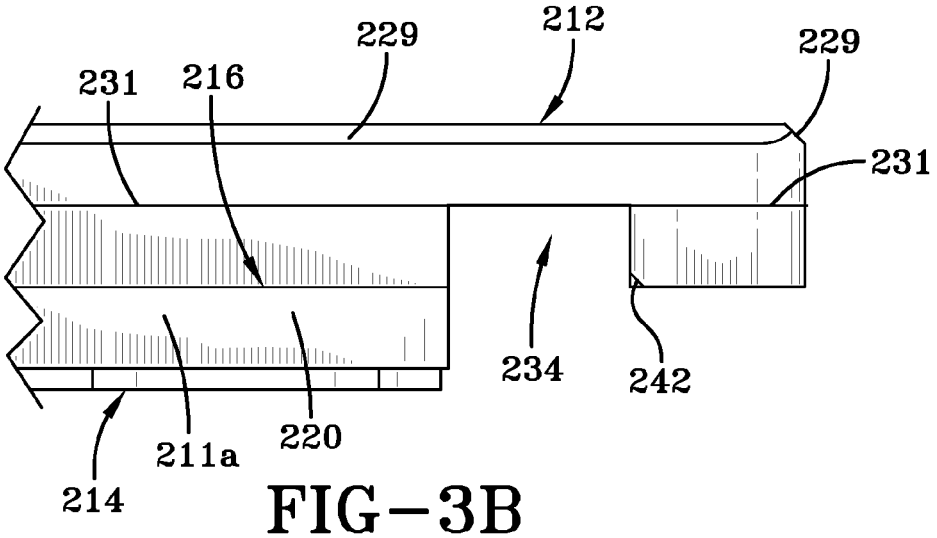
FIG. 3B is a partial side view of a corner of another of the sides of the tile of FIG. 1.
Figure 3C:
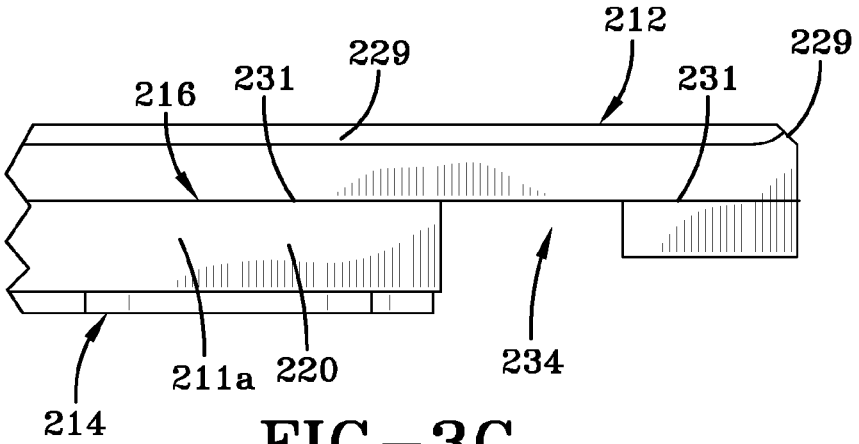
FIG. 3C is a partial side view of a corner of another embodiment of the tile.
Figure 6A:
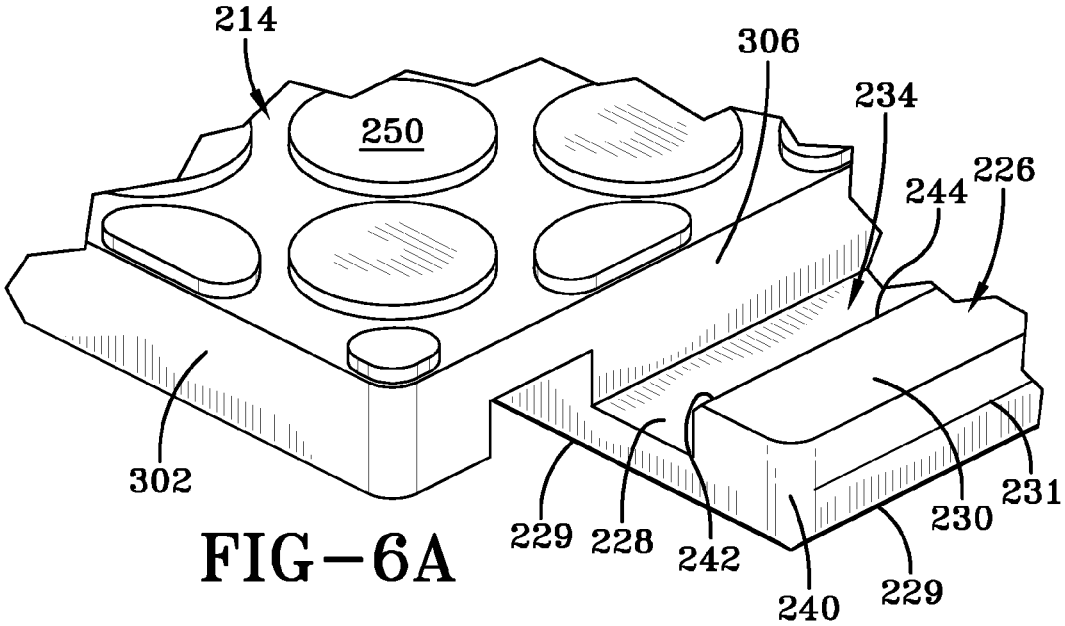
FIG. 6A is another enlarged partial bottom perspective view of another corner of the tile of FIG. 1.
Figure 6B:
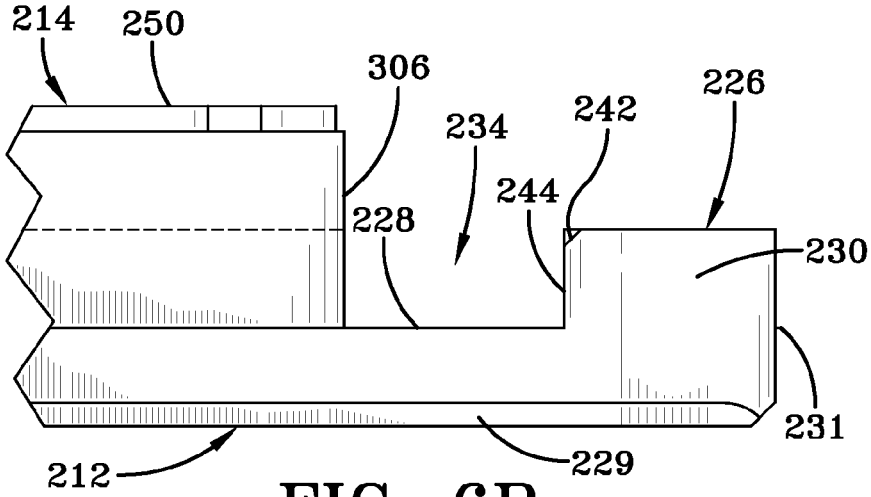
FIG. 6B is a partial side view of a corner of still another side of the tile of FIG. 1.
Figure 6C:
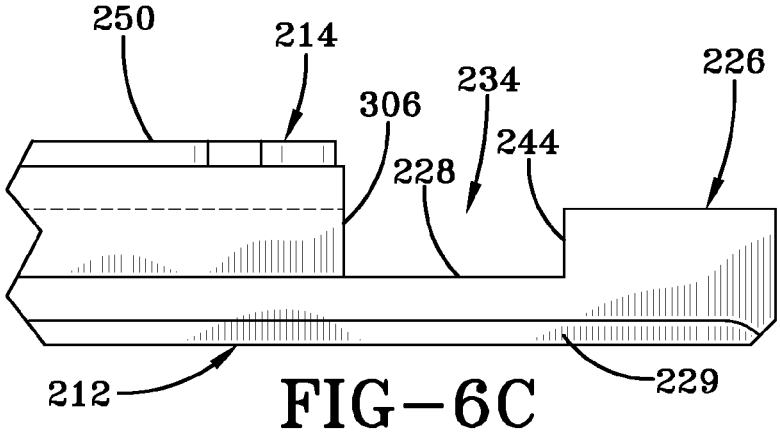
FIG. 6C is a partial side view of a corner of still another side the other embodiment of the tile as shown in FIG. 3C.

In a preferred embodiment, the male locking projections 220 and 230 on the corresponding interlocking element sets 216 and 226, respectively, have a generally square-shaped cross-section as shown in FIGS. 3A, 3B and 6B, for reasons hereinafter described. However, the cross-section can include some type of dove-shaped designs as well.

Figure 7A:
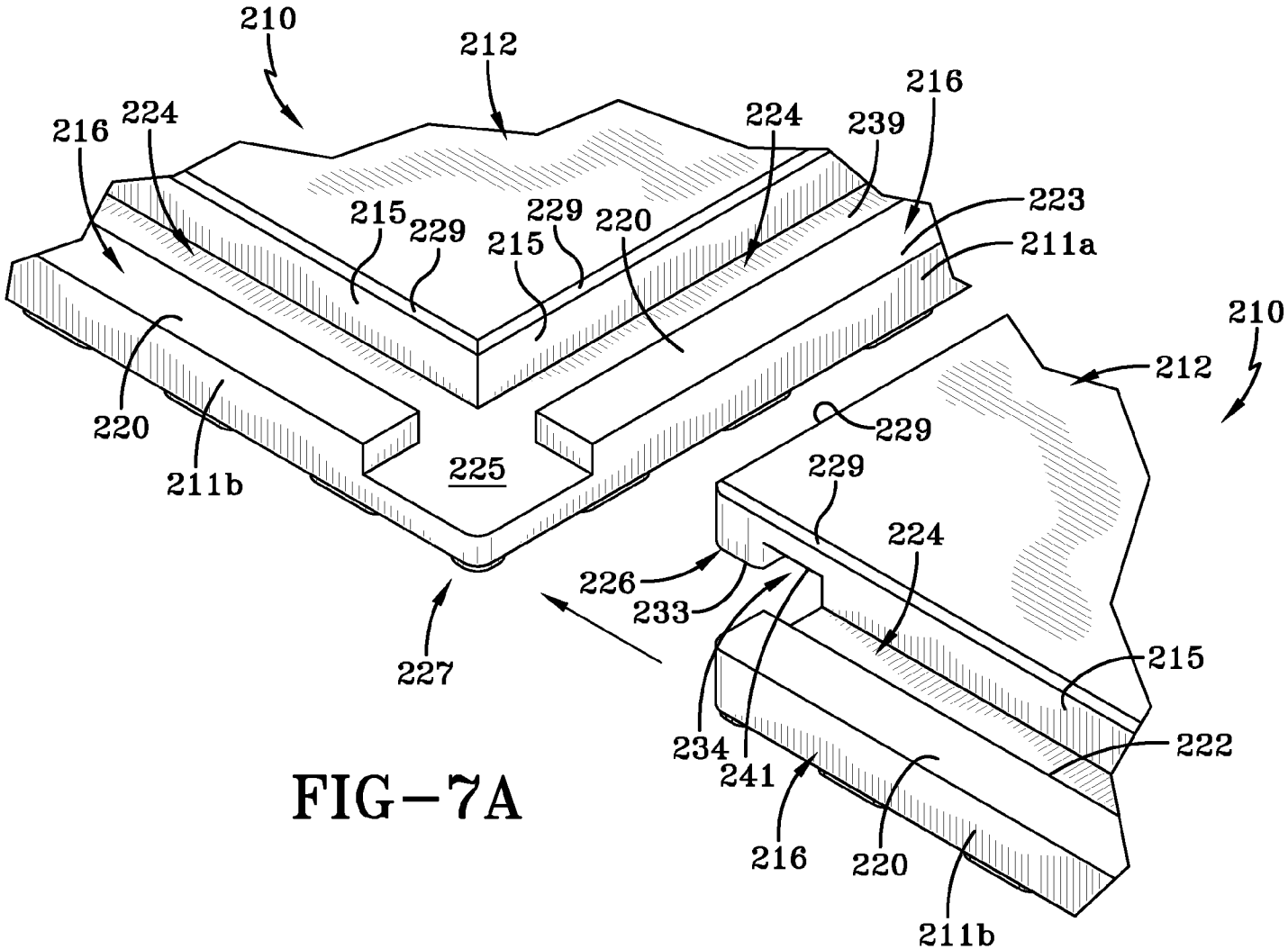
FIG. 7A is a top partial perspective view of two adjacent tiles before assembly.
Figure 7B:
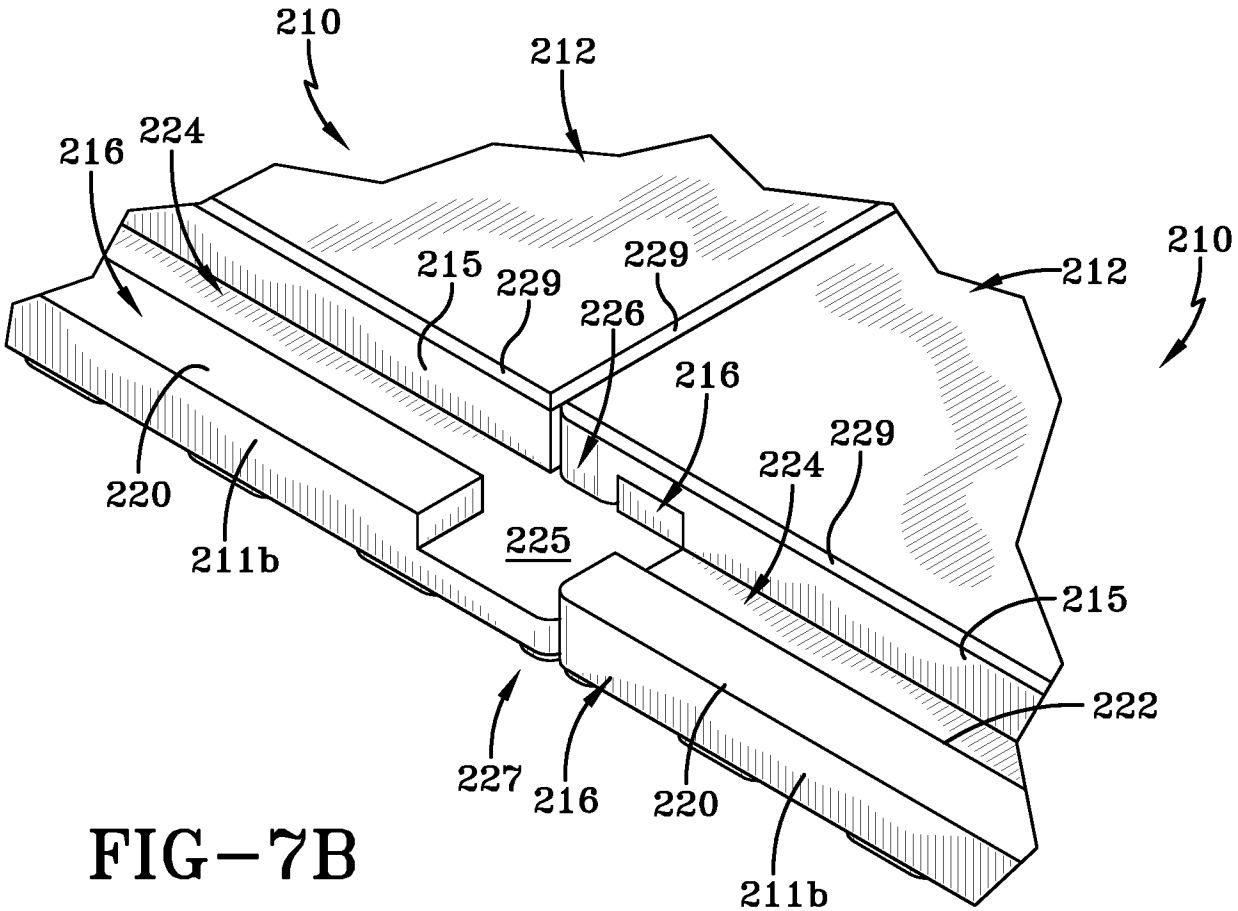
FIG. 7B is a top partial perspective view of two adjacent tiles after assembly.
Figure 7C:
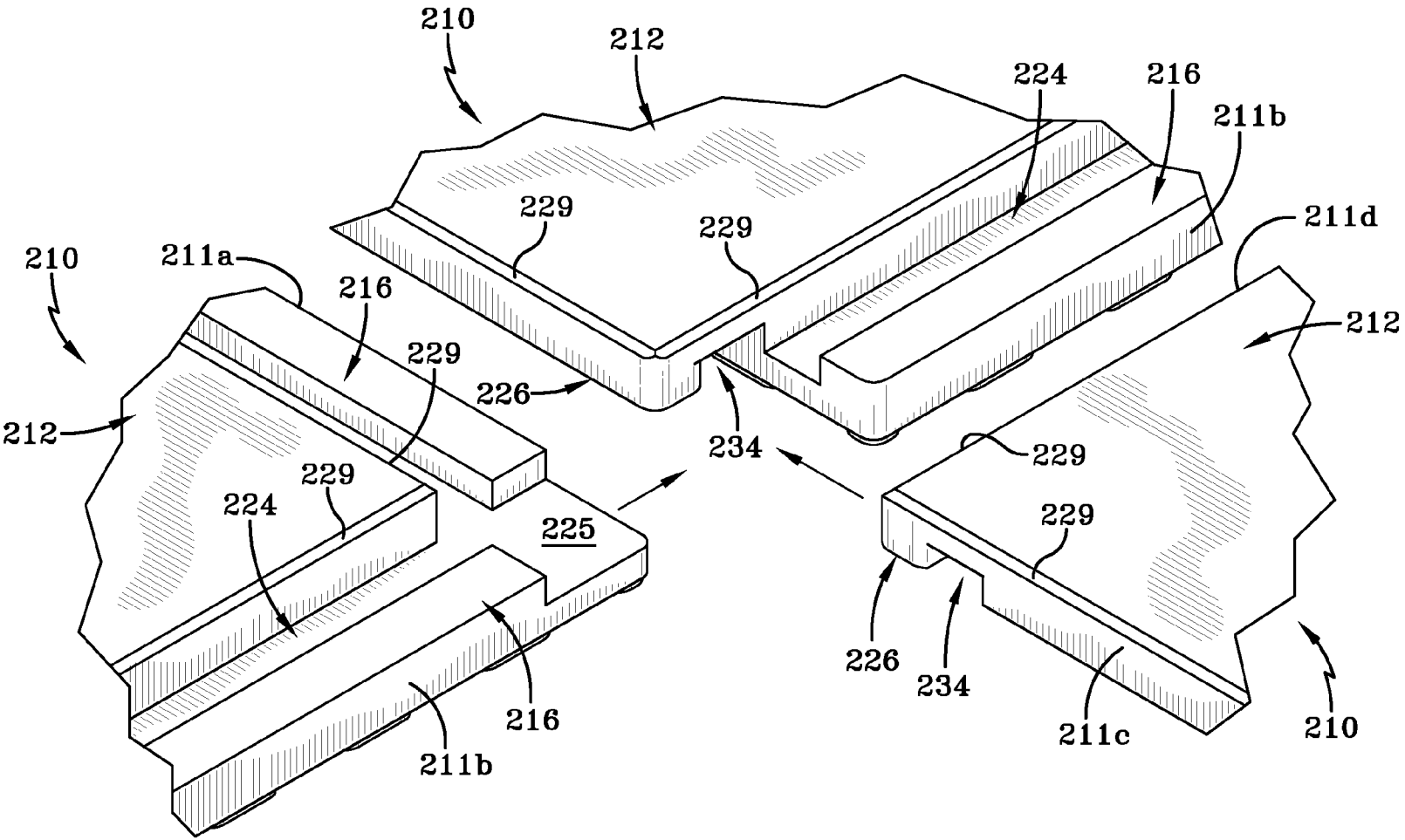
FIG. 7C is a top partial perspective view of three adjacent tiles before assembly.

Considering FIGS. 2A-2C and 3A-3B, the upper edges of each tile 210 are slightly curved or canted (such as with a flat surface) as shown at numeral 229. Since when installed the respective tiles 210 may not be in the same plane at their upper surface, one would not want any tile to jut upwardly even if it not be so high as to cause possible tripping when walking thereacross, so as to spoil the smooth appearance. Therefore, curves or cants 229 may be visible, but are not unsightly, which would add aesthetic appeal to the floor as shown in FIGS. 7A-7C. The appearance might be particularly noticeable early or late in the day when sunlight strikes the floor at a very small angle, but would not be visually unpleasant to observe.

Since the present invention is manufactured from molding methods well known in the art, flashing is likely to remain on certain areas of tile 210 as previously discussed. Flashing occurs during the molding process, where rubber or other material oozes along the edges of the mold which leaves excess material (i.e. flashing) after the tile cures. Flashing normally occurs at various edges of tile 210, including the respective interlocking element sets 216 and 226. This excess flashing must usually be removed in order for tiles 210 to be able to lock together. A utility knife or other suitable tool is used to trim the excess flashing. Since the interlocking element sets 216 and 226 run the full length of tile 210 without interruption, excess flashing is easily removed with a utility knife using one continuous motion. There are no curves or sharp corner edges (i.e. as in puzzle pieces) that need to be traced and subsequently trimmed with the utility knife. This greatly reduces installation time.

Figure 9:
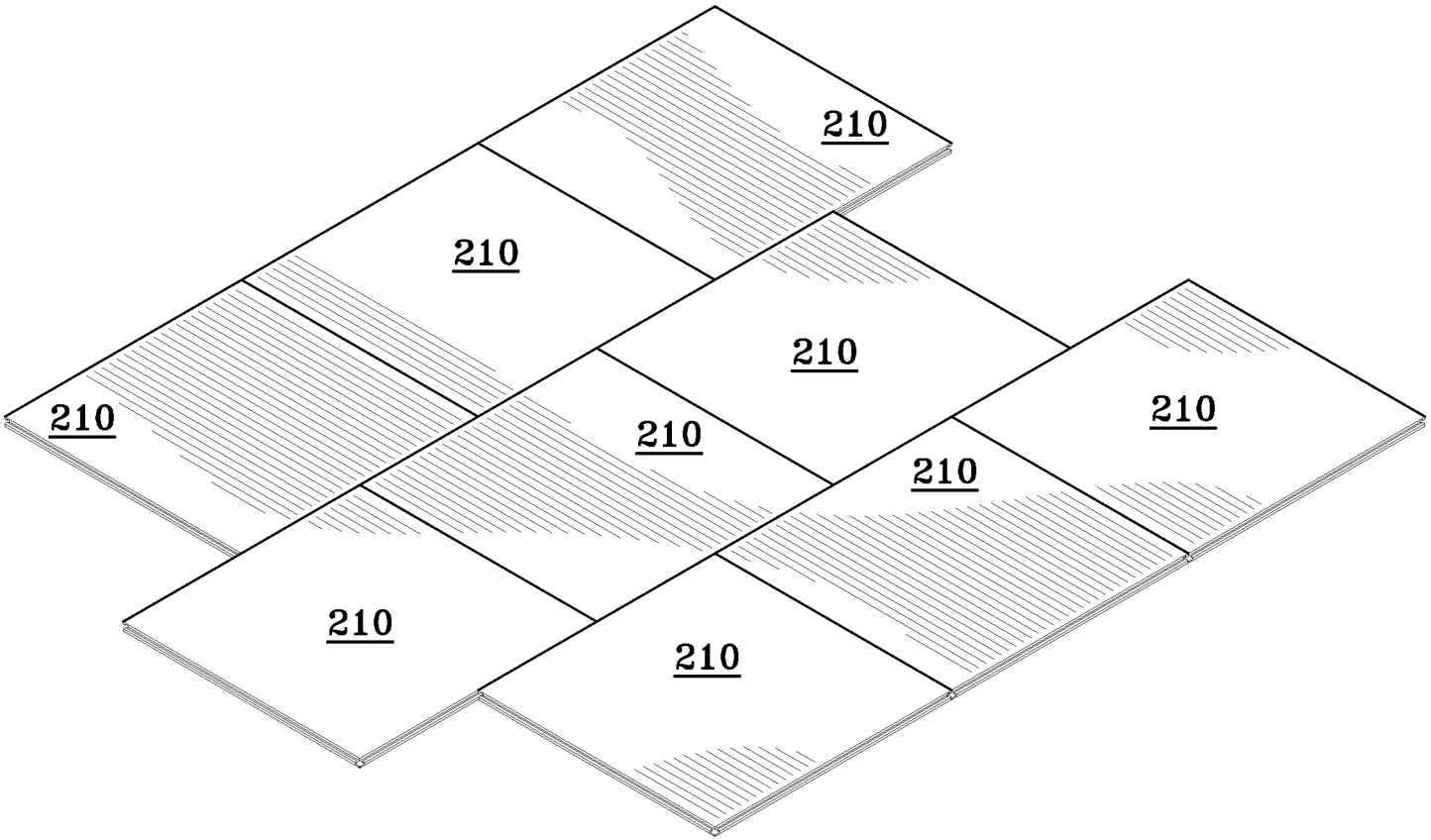
FIG. 9 is a top perspective view of multiple staggered tiles after assembly.
Figure 10:
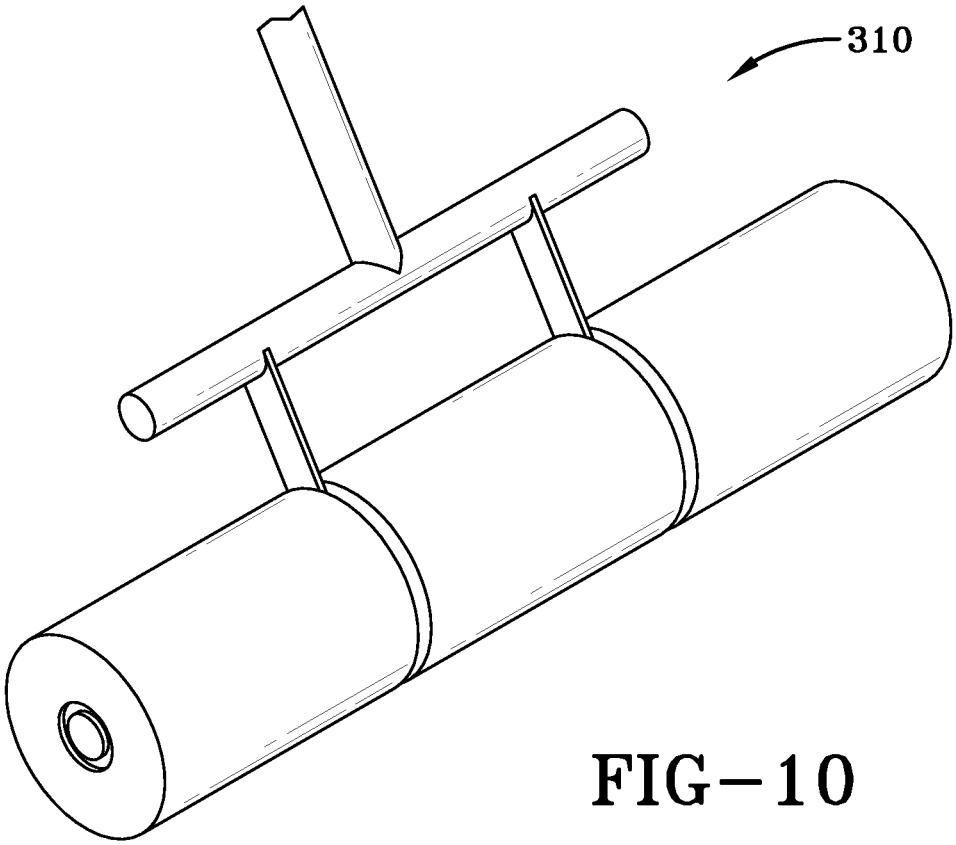
FIG. 10 is a perspective of a large seam roller for interlocking tiles.
Figure 11:
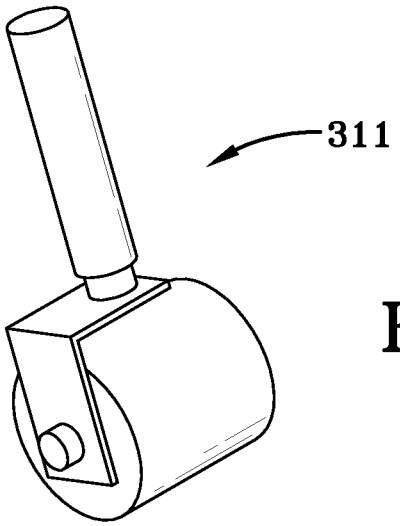
FIG. 11 is a perspective view of a hand seam roller for interlocking tiles.

There are additional advantages of the present invention based on the continuous connection along all sides of tile 210 since there is no interruption in respective interlocking element sets 216 and 226. Tiles could be locked together with a commonly used large seam roller or hand seam roller. A typical large seam roller 310 is shown in FIG. 10. Large seam roller is heavily weighted and pushed from behind by a person to roll over and smooth interlocking tiles. The weight of the roller 310 itself pushes the tiles down to fully engage one another. Alternatively, a hand seam roller 311, as shown in FIG. 11, can be used by an installer to physically push the locking mechanisms into place. This allows the connection or joint where two tiles 210 meet to remain tight, which will provide a better appearance and prevent dirt and other debris and even possibly moisture from entering the joint. Another advantage of the continuous connection or joint is the prevention of realignment problems with tiles 210. As previously mentioned with respect to the prior art, individual locking tabs or a discontinuous locking connection will result in possible realignment problems. Finally, since the interlocking element sets 216 and 226 run the full length of tile 210 without interruption, the tiles 210 can be staggered to form any type of pattern or design (i.e. tiles 210 do not need to be corner to corner). For example, FIG. 9 shows a number of tiles in a staggered pattern.

In order to maintain a tight joint as discussed above, the interlocking element sets 216 and 226 have a generally square-shaped cross section as shown in FIGS. 3A, 3B and 6B. Respective male locking projections 220 and 230 are press fit into respective bottom and top channels 224 and 234, respectively, easily done with seam roller 310 or hand seam roller 311. Since tile 210 is flexible, there is some elasticity when male locking projections 220 and 230 are fit into bottom and top channels 224 and 234. However, an initial force must be overcome to begin the press fit of tiles 210 together. In order to help overcome this initial force, interlocking element sets 216 and 226 include rounded and/or chamfered edges and corners in order to provide a small space or relief to overcome the initial force. Top downwardly-extending male locking projection 230 includes rounded corners 240 as shown in FIG. 5A. For the ⅜ inch version of tile 210, top locking element set 226 in bottom portion 214 additionally has a chamfered edge 242 which runs along an inside edge 244 of top male locking projection 230 as shown in FIGS. 5A-5D and 6A, 6B. Support post 238 also includes rounded edges 246. Rounded corners 240, chamfered edge 242 and rounded edges 246 provide a small space or relief when top downwardly-extending male locking projection 230 is initially press fit into respective bottom channels 224. This space or relief is especially necessary in case any excess flashing remains on interlocking element sets 216 and 226. For example, if a small piece of flashing remains on bottom male locking projection 220 (FIGS. 2A-3B), chamfered edge 242 of top male locking projection 230 will provide space or relief for the flashing and will allow top male locking projection 230 to be fit into bottom channel 224. Even if no excess flashing exists, chamfered edge 242 will allow top male locking projections 230 to enter into bottom channel 224 and overcome the initial force of fitting and locking tiles 210 together.

In the ¼ inch version of tile 210, a chamfered edge is not included on inside edge 244 of top male locking projection 230 since less material is engaged between interlocking floor tiles 210 as shown in FIGS. 3C, 5E-5F and 6C. Having a chamfered edge would create even less of an engagement between male locking projections 220 and 230 of the thinner tile 210. In other words, since the ¼ inch version of tile 210 is thinner than the ⅜ inch version of tile 210, and therefore bottom upwardly extending male locking projections 220 and 230 are smaller for the ¼ inch tile, a chamfered edge would create less engagement between the respective bottom upwardly extending male locking projection 220 and top downwardly extending male locking projection 230. Therefore, the ¼ inch version of tile 210 is devoid of a chamfered edge on inside edge 244.

Parting lines 221 and 231 also assist in the interlocking of tiles 210. Specifically, parting lines 221 and 231 help to maintain the locking of the tiles 210 together. As stated above, parting lines 221 and 231 are small lines of material which protrude respectively from male locking projections 220 and 230. When male locking projections 220 and 230 are press fit into respective top and bottom channels 234 and 224, parting lines 221 and 231 ensure that the press fit is tight and not loose (i.e. parting lines 221 and 231 are pressed into inner walls 232, and outwardly-facing top planar walls 215, and such inwardly-facing walls 232 and outwardly-facing top planar sidewalls 215 exert a corresponding reciprocal force into parting lines 221 and 231 of male projections 220 and 230 to create the press fit). A tight fit also prevents any lateral or vertical sliding of male locking projections 220 and 230 within respective top and bottom channels 234 and 224. Specifically, friction created between walls 211*a*, 211*b*, and walls 211*c*, 211*d* of respective male locking projections 220 and 230 (i.e. the vertical walls of male locking projections 220 and 230) prevents any lateral or vertical sliding of tiles 210. Additional friction is created between respective horizontal surfaces 223, 233 of male locking projections 220 and 230 and horizontal surfaces 239, 241 of respective bottom and top channels 224 and 234 when engaged as shown just before engagement in FIG. 7A. Male locking projections 220 and 230 are fully engaged with respective bottom and top channels 224 and 234, that is, horizontal surfaces 223, 233 of male locking projections 220 and 230 and the horizontal surfaces 239, 241 of respective bottom and top channels 224 and 234 are coplanar and touching one another, thus creating friction between them. Since tile 210 is preferably made from rubber as set forth above, and rubber is more slip resistant to resist shifting and more difficult to lift up or slide than compared to other materials not including rubber, the friction created between male locking projections 220 and 230 engaged with respective bottom and top channels 224 and 234 is even greater than it would be with other materials not including rubber. Tiles made from vinyl are loosely held together with interlocking arrangements, are more prone to shifting and sliding, and may lift easier on their own. Therefore, there is no clearance or gaps or loose fits between male locking projections 220 and 230 and respective bottom and top channels 224 and 234 when engaged. This friction ensures that tiles 210 are not displaced (i.e. unlocked) from one another when in use. This differs from prior art interlocking mechanisms where a clearance or a gap is necessary to allow for the natural expansion of the material, such as wood.

In order to interlock tiles 210 together, a pair of tiles 210 are positioned adjacent each other as shown in FIG. 7A, but may also be staggered as mentioned above and shown in FIG. 9. Top downwardly extending male locking projection 230 of top interlocking element set 16 is inserted into bottom channel 224 of adjacent tile 210. Rounded corners 240, chamfered edge 242 and rounded edges 246 provide a small space or relief when top downwardly extending male locking projection 230 is initially press fit into respective bottom channels 224. Bottom upwardly extending male locking projection 220 is then inserted into top channel 234 of top interlocking element set 226. The square cross-section configuration of male locking projections 220 and 230 including parting lines 221 and 231 maintain the connection between adjacent tiles 210 and prevent lateral movement of tiles 210 when placed on top of a subfloor as shown in FIG. 7B. Since tile 210 is flexible, respective interlocking element sets 216 and 226 can slightly deform when engaged with one another to secure tiles together and provide a tight joint. FIG. 7C shows multiple tiles 210 being joined together.

Bottom portion 214 includes a continuous grid of shallow flat round studs 250 that flow uninterrupted into adjacent tiles 210 when installed as shown in FIG. 8B. Studs 250 may provide moisture flow when uncured concrete (or moist subflooring) is still drying, and more cushioning effect for tile 210 when a load is imposed thereon such as when tiles 210 are walked upon, vehicles are transported across, cleaning and repair equipment are disposed thereon or the like. The use of studs 250 provides less contact with the subfloor. If the subfloor has old adhesive or contaminants, it will be easier to pull up, if needed. Thus, studs 250 are easier to disengage from a floor or subfloor, facilitating installation and removal of particular tiles 210. Incorporating studs also lessens the weight of the tile. This is more ergonomically friendly for the installer and more ecologically friendly since less fossil fuels are required to transport the tiles.

Interlocking floor tiles 210 have many applications and have been engineered for performance for various types of sports flooring or other multi-functional flooring. The ⅜ inch version of interlocking floor tile 210, which is thicker than the ¼ inch version, is more durable, spike-resistant, skate-resistant and slip-resistant. The former interlocking floor tile 210 bears the brunt of constant foot traffic, sports activities, heavy rolling and abuse from objects like sporting equipment. Additionally, the ⅜ inch version of interlocking floor tile 210 can absorb more of the noise generated in these types of environments and is ideal for areas where extreme activity involving spikes, skates or free weights is not present. The ¼ inch version is durable and used where normal or non-extreme sporting activities are present. Either thickness will help to cover up seams over access flooring while still allowing access to the floor below for repairs or reconfigurations. The ¼ inch version, as noted above, is satisfactory in these instances to protect the floor on which the tile is installed.

Interlocking floor tiles 210 install easily and without adhesive for speedy installation and quick turnaround time. Interlocking floor tiles 210 are easily removed, and reinstalled as needed and easy to replace if necessary. Interlocking floor tiles are manually releasable using a hand tool. For example, for subfloors with contamination or moisture problems, interlocking floor tiles 210 permit periodic inspection or removal for servicing. Interlocking floor tiles 210 can be a temporary or permanent solution for applications over access flooring or where the subfloor is not suitable for adhering tile. Finally, interlocking floor tiles 210 can be repurposed to other locations.

Interlocking floor tiles 210 can be lined up corner-to-corner or staggered anywhere (i.e. offset) along the edge of the tiles to form unique patterns. For example, checkerboard, zig-zags or other motifs can be created since such designs have no limitations due to the edges of tile 210 being able to lock and align at any other point along the continuous edge of another tile.

Tiles according to the present invention can be easily maintained by using a damp mop or microfiber pad along with a minimal amount of water and cleaning solution. This maintenance technique avoids water migrating to the subfloor through the hidden locking mechanism.

Although the invention has been described with regard to certain preferred example embodiments, it is to be understood that the present disclosure has been made by way of example only, and the improvements, changes and modifications in the details of construction and the combination and arrangement of parts may be resorted to without departing from the spirit and scope of the invention. Such improvements, changes and modifications within the skill of the art are intended to be covered by the scope of the present disclosure.

What is claimed:

1. A flexible interlocking floor tile having a rectangular shape for being placed over a floor or subfloor, said floor tile comprising:

a top portion and a bottom portion, said top portion including a resilient first material having a rubber component and facing away from the floor or subfloor when said flexible interlocking floor tile is placed on a floor or subfloor, and said bottom portion including a flexible second material different from said first material and having a rubber component and facing the floor or subfloor when said flexible floor tile is placed on the floor or subfloor, said top portion and said bottom portion being initially separate and independent, but are configured to be assembled into said flexible interlocking floor tile; said top portion and said bottom portion being combined to ether b vulcanization to form said flexible interlocking floor tile as a dual construction, said dual construction comprising said top portion and said bottom portion;

said top portion comprising:

a top layer;

outwardly-facing top planar sidewalls on two first adjacent planar side portions of said tile;

a bottom interlocking element set including a bottom base extending outwardly from each of said outwardly-facing top planar sidewalls and a bottom upwardly extending male locking projection, said bottom upwardly extending male locking projection having an inwardly-facing bottom planar wall spaced from each of said outwardly-facing top planar sidewalls defining a bottom channel therebetween, said bottom upwardly extending male locking projection having a parting line protruding outwardly away from said inwardly facing bottom planar wall; and a bottom base element connecting respective bottom interlocking element sets on said respective adjacent side portions and forming a lower corner of said floor tile, said bottom base element being devoid of any male locking portion projecting therefrom;

said bottom portion comprising:

a base layer;

outwardly-facing bottom planar sidewalls on the two second adjacent planar side portions of said tile opposite said respective two first adjacent planar side portions, said two second adjacent planar side portions meeting at an upper corner of said floor tile;

a top interlocking element set including a top base extending outwardly from each of said outwardly-facing bottom planar sidewalls and a top downwardly extending planar male locking projection, said top downwardly extending planar male locking projection having an inwardly-facing top planar wall spaced from each of said outwardly-facing bottom planar sidewalls defining a top channel therebetween, said top downwardly extending planar male locking projection having a parting line protruding outwardly away from said inwardly-facing top planar wall; and a top base element connecting respective top interlocking element sets on said two second adjacent side portions of said tile and forming said upper corner of said floor tile, said top base element including a downwardly depending support post for providing support in conjunction with the bottom base element in response to said support post being seated on said top base element when multiple ones of said tiles are joined together;

wherein said bottom upwardly extending planar male locking projection fully engages said top channel without any gap therebetween, said top downwardly extending planar male locking projection fully engages said bottom channel without any gap therebetween, said two second adjacent planar side portions frictionally engage said outwardly-facing top planar sidewalls, and said inwardly-facing top planar walls frictionally engages said respective bottom inner planar walls when two or more tiles are locked together, said parting line of said bottom upwardly extending male locking projection engaging said outwardly-facing bottom planner sidewall and said inwardly-facing top planar wall forming said top channel to assist in the interlocking of a pair of said flexible interlocking floor tiles together, and said parting line of said top downwardly extending male locking projection engaging said inwardly-facing bottom planar wall and said outwardly-facing top planar sidewall defining said bottom channel to assist in the interlocking of a pair of said flexible interlocking floor tiles.

2. A flexible interlocking floor tile according to claim 1 wherein said top portion and said bottom portion comprise rubber components.

3. A flexible interlocking floor tile according to claim 1 wherein said top interlocking element set comprises said resilient material and said elastic material.

4. A flexible interlocking floor tile according to claim 1 wherein said bottom interlocking element set comprises said resilient material and said elastic material.

5. A flexible interlocking floor tile according to claim 1 wherein said top layer further comprises an upper edge on each side portion of said tile, said respective upper edges being curved or canted.

6. A flexible interlocking floor tile according to claim 1 wherein said bottom portion comprises approximately 73% recycled rubber and approximately 27% virgin materials including rubber.

7. A flexible interlocking floor tile according to claim 1 wherein said top portion has a thickness in the range of 0.070-0.110 inches or approximately 1.7 mm 2.8 mm.

8. A flexible interlocking floor tile according to claim 1 wherein said bottom portion has a thickness in the range of 0.265-0.305 inches or approximately 6.7 mm - 7.7 mm.

9. A flexible interlocking floor tile according to claim 1 wherein said bottom portion has a thickness in the range of 0.140-0.180 inches or approximately 3.5 mm-4.5 mm.

10. A flexible interlocking floor tile according to claim 1 wherein said tile comprises approximately 53% recycled rubber and approximately 47% virgin materials including rubber.

11. A flexible interlocking floor tile according to claim 1 wherein said tile has a thickness of approximately ⅜ inch.

12. A flexible interlocking floor tile according to claim 1 wherein said tile has a thickness of approximately ¼ inch.

13. A flexible interlocking floor tile according to claim 1 wherein said tile has a hardness of greater than 85 Shore A.

14. A flexible interlocking floor tile according to claim 1 wherein said tile has a hardness of greater than 70 Shore A.

15. A flexible interlocking floor tile according to claim 1 wherein said tile has a slip resistance coefficient of greater than or equal to 0.8.

16. A flexible interlocking floor tile according to claim 1 wherein said tile has an abrasion resistance of 1 g loss after 1000 cycles.

17. A flexible interlocking floor tile according to claim 1 wherein said tile has an impact sound resistance of 46(IIC).

18. A flexible interlocking floor tile according to claim 1 wherein said tile has a force reduction of 6.

19. A flexible interlocking floor tile according to claim 1 wherein said top portion includes a hammered texture.

20. A flexible interlocking floor tile according to claim 1 wherein both of said top male locking projection and said bottom male locking projection include rounded corners for providing a small space or relief when said top male locking projection is engaged with said bottom channel and said bottom male locking projection is engaged with said top channel.

21. A flexible interlocking floor tile according to claim 1 wherein said top male locking projection includes a chamfered edge for providing a small space or relief when said top male locking projection is engaged with said bottom channel.

22. A flexible interlocking floor tile according to claim 1 wherein the interlocking tiles are manually releasable using a hand tool.

23. A flexible interlocking floor tile according to claim 1 wherein the tiles interlock without the use of glue or other adhesive.

24. A flexible interlocking floor tile according to claim 1 for sports flooring, where said top portion is made of a premium formulation including rubber in the approximate range of 35%-45% rubber.

25. A flexible interlocking floor tile according to claim 1 for normal flooring, where said top portion is made of a premium formulation including rubber in the approximate range of 25%-27% rubber.

* * * * *

UNITED STATES PATENT AND TRADEMARK OFFICE

CERTIFICATE OF CORRECTION

PATENT NO. : 8,650,824 B2
APPLICATION NO. : 13/706058
DATED : February 18, 2014
INVENTOR(S) : Patrick DeLong et al.

It is certified that error appears in the above-identified patent and that said Letters Patent is hereby corrected as shown below:

In the Specification

Column 16, line 23 the phrase “to ether b” should read --together by--;

Column 17, line 19 the word “planner” should read --planar--;

Column 17, line 48 insert a -- - -- between “1.7 mm” and “2.8 mm” to read “1.7 mm - 2.8 mm”.

Signed and Sealed this
Twenty-third Day of September, 2014

Michelle K. Lee

Michelle K. Lee
*Deputy Director of the United States Patent and Trademark Office*